US008487173B2

(12) United States Patent
Emmerson

(10) Patent No.: US 8,487,173 B2
(45) Date of Patent: Jul. 16, 2013

(54) METHODS FOR ONLINE COLLABORATIVE MUSIC COMPOSITION

(76) Inventor: Parker M. D. Emmerson, Chapel Hill, NC (US)

( * ) Notice: Subject to any disclaimer, the term of this patent is extended or adjusted under 35 U.S.C. 154(b) by 65 days.

(21) Appl. No.: 12/494,945

(22) Filed: Jun. 30, 2009

(65) Prior Publication Data

US 2010/0326256 A1 Dec. 30, 2010

(51) Int. Cl.
*G10H 7/00* (2006.01)

(52) U.S. Cl.
USPC ..... 84/601; 84/602

(58) Field of Classification Search
USPC ..... 84/600–602
See application file for complete search history.

(56) References Cited

U.S. PATENT DOCUMENTS

| | | | | |
|---|---|---|---|---|
| 6,653,545 | B2 * | 11/2003 | Redmann et al. | 84/615 |
| 6,898,637 | B2 * | 5/2005 | Curtin | 709/231 |
| 7,297,858 | B2 * | 11/2007 | Paepcke | 84/609 |
| 7,405,355 | B2 * | 7/2008 | Both et al. | 84/645 |
| 7,518,051 | B2 * | 4/2009 | Redmann | 84/601 |
| 7,649,136 | B2 * | 1/2010 | Uehara | 84/610 |
| 7,714,222 | B2 * | 5/2010 | Taub et al. | 84/600 |
| 2001/0042056 | A1 * | 11/2001 | Ferguson | 706/10 |
| 2002/0091847 | A1 * | 7/2002 | Curtin | 709/231 |
| 2002/0095392 | A1 * | 7/2002 | Ferguson et al. | 706/10 |
| 2002/0165921 | A1 * | 11/2002 | Sapieyevski | 709/204 |
| 2003/0164084 | A1 * | 9/2003 | Redmann et al. | 84/615 |
| 2005/0120865 | A1 * | 6/2005 | Tada | 84/600 |
| 2005/0173864 | A1 * | 8/2005 | Zhao | 273/299 |
| 2006/0112814 | A1 * | 6/2006 | Paepcke | 84/645 |
| 2006/0123976 | A1 * | 6/2006 | Both et al. | 84/600 |
| 2007/0028750 | A1 * | 2/2007 | Darcie et al. | 84/625 |
| 2007/0039449 | A1 * | 2/2007 | Redmann | 84/609 |
| 2007/0044639 | A1 * | 3/2007 | Farbood et al. | 84/609 |
| 2007/0140510 | A1 * | 6/2007 | Redmann | 381/97 |
| 2007/0255816 | A1 * | 11/2007 | Quackenbush et al. | 709/223 |
| 2008/0047413 | A1 * | 2/2008 | Laycock et al. | 84/477 R |
| 2008/0060499 | A1 * | 3/2008 | Sitrick | 84/477 R |
| 2008/0060506 | A1 * | 3/2008 | Laycock et al. | 84/645 |
| 2008/0190271 | A1 * | 8/2008 | Taub et al. | 84/645 |
| 2008/0201424 | A1 * | 8/2008 | Darcie | 709/204 |
| 2008/0215681 | A1 * | 9/2008 | Darcie et al. | 709/204 |
| 2008/0264241 | A1 * | 10/2008 | Lemons | 84/601 |
| 2009/0070420 | A1 * | 3/2009 | Quackenbush | 709/204 |
| 2009/0156179 | A1 * | 6/2009 | Hahn et al. | 455/414.1 |
| 2009/0172200 | A1 * | 7/2009 | Morrison et al. | 709/248 |
| 2010/0058920 | A1 * | 3/2010 | Uehara | 84/609 |
| 2010/0132536 | A1 * | 6/2010 | O'Dwyer | 84/609 |
| 2010/0146405 | A1 * | 6/2010 | Uoi et al. | 715/756 |
| 2010/0212478 | A1 * | 8/2010 | Taub et al. | 84/645 |
| 2010/0319518 | A1 * | 12/2010 | Mehta | 84/625 |
| 2010/0326256 | A1 * | 12/2010 | Emmerson | 84/610 |

OTHER PUBLICATIONS

"A system for Collaborative Music Composition over the Web." 2000. S. Jorda, et al. Viewed online Mar. 1, 2011 http://citeseerx.ist.psu.edu/viewdoc/download?doi=10.1.1.18.5598&rep=rep1&type=pdf.*

* cited by examiner

*Primary Examiner* — David S. Warren
(74) *Attorney, Agent, or Firm* — Triangle Patents, PLLC

(57) ABSTRACT

Systems and methods for creating and editing collaborative music compositions via a computer network, including remote uploading tracks by musicians, and for creating and joining a band, wherein the system and methods provide for at least one musician to join a virtual group of at least one other musician for the purpose of virtual collaborative creating and/or editing music tracks remotely, via an online network and interactive website therefor.

12 Claims, 42 Drawing Sheets

This is what the homepage looks like to a logged in musician (User 1) who has created 3 bands.

Figure 2

MyBlogBand
(title of site)

(Website Logo)

(hyperlinks to homepage)

Welcome
User 1
View my profile
Edit my profile
Change password
Manage my photos
Manage my music Start a band
User 1's band 1
User 1's band 2
User 1's band 3
(these are hyperlinks)

Bands Musicians Tutorial
(these are hyperlinks)

My Music (music to be displayed on user 1's profile)

Music Player Click an item to start

1 Song 1 Date Created Track name [play][edit][delete]
Notes about song 1
2 Song 2 mm/dd/year track X.mp3 [play][edit][delete]
Notes about song 2
3 Song 3 mm/dd/year track Y.mp3 [play][edit][delete]
Notes about song 3. (Written description)
4 Song 4 mm/dd/year track Z.mp3 [play][edit][delete]
Notes about song 4
5 Song 5 mm/dd/year track A.mp3 [play][edit][delete]
Notes bout song 5

(The notes section allows the musician to add a copyright license, creative commons license, lyrics, or notation for the track at hand.)

(Each phrase is a hyperlink. Song 2, for example, plays track X.mp3 in the player. If you click edit, it will take you to a place to upload a new track or edit the notes about the song. Clicking delete deletes the song and track.)

Figure 4

Myblogband Logo hyperlinks to homepage

Band Profile

User 1's Band 1

Rock, Ambient

Primary Band Image

Band Image Gallery (view more)

Music Player (click item)
Rewind, Play, Stop, Fast Forward

Influences
The Postal Service,
The Beatles, Mozart

Welcome
User 1

View My Profile
Edit My Profile
Change Password
Manage My Photos
Manage My Music start a band
User 1's Band 1
User 1's Band 2
User 1's Band 3

User 1's Band 1
View Band Profile
Edit Band Profile
Manage Band Photos
Manage Band Music (These are hyperlinks)

Song ABC mm/dd/yy download plays: 42 tracks
Song DEF mm/dd/yy download plays: 20 tracks
Song GHI mm/dd/yy download plays: 20 tracks
Song JKL mm/dd/yy download plays: 20 tracks
Song MNO mm/dd/yy download plays: 20 tracks
Song PQR mm/dd/yy download plays: 20 tracks Etc.

(A user can click, for example, the title "Song ABC" and it will play the track associated as the default track for that song. Default tracks are selected from manage band music for a given band.)

Members (A list of band members)
User 1 - Keyboard
User 2- Electric Guitar
User 3 - Percussion (Clicking on a user takes you to their musician profile.)

Comments (A section for leaving and displaying comments. Anyone on the site can leave a comment.)

Figure 5

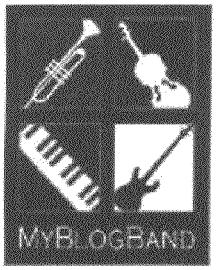

Welcome
powerinthelines!
view my profile
edit my profile
change password
manage my photos
manage my music start a band
The Clinic
Velvet Boys
secondary colors
Band of Garage
Playground of the Ancient
Space Dock 1
parker and daron
band 1 to be named
Ryan Eldridge and
The New Shakers
The Sound Clash
Ministry
Antioch Audio Production
The Bhodi Dyin'
Musical
Irish Medieval
Fantastico
Forward
Backward: The Door to Stop
Focus

Space Dock 1
view band profile
edit band profile
manage band photos
manage band music log out

Band Profile

Space Dock 1

Impressionist, Electronic, Experimental

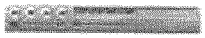

| | | | |
|---|---|---|---|
| Violet | 07/04/07 | downloadtracks | plays: 47 |
| Terrorist | 07/04/07 | tracks | plays: 36 |
| Someone's Coming Down the Stairs | 08/08/07 | downloadtracks | plays: 42 |
| Ilocy | 08/14/07 | downloadtracks | plays: 9 |
| (c) Zachary Davidson | | | |
| The Ever Cycling Grace | | tracks | plays: 25 |
| Imaginary No. 1 | 07/05/07 | downloadtracks | plays: 16 |
| By the Fountain, it is Cool | 08/08/07 | downloadtracks | plays: 16 |
| Goedel's Proof | 07/04/07 | downloadtracks | plays: 23 |
| Red Sky Raining | 07/04/07 | downloadtracks | plays: 37 |
| The Dark Pine Forest | 06/23/07 | downloadtracks | plays: 57 |
| © parker emmerson | | | |

Members
Parker Emmerson - Piano
[remove myself from this band]
Ian Thomson - Electric Bass
Brian La Rue - Drums
Zach Davidson - Piano
Lon Withrow - Electric Guitar
Erik Baumann - Electric Guitar

Comments rectified.

Posted Tue Aug 14, 2007 12:53pm by keyofz [delete this comment]

Parker. Great job on the recent entries. I can't wait to play with those sounds while we are gathered together.

Posted Mon Aug 13, 2007 12:06am by keyofz [delete this comment]

hey, i showed my cousin evan blogband last week and he joined. he's extemely talented..his bands name is mobile bunker...i think you or all of us should create through the site Posted Wed Aug 8, 2007 12:52am by Lucy Martier [delete this

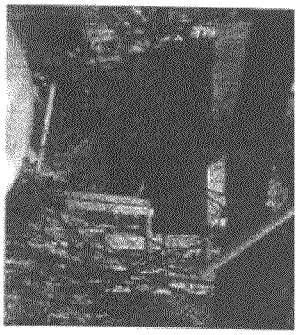

band image gallery

Description
Experience the beauty in a sound and silence

Influences
Cage

Figure 6

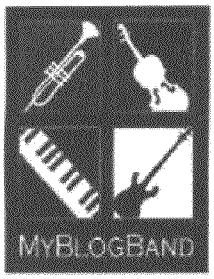

Welcome powerinthelines!
view my profile
edit my profile
change password
manage my photos
manage my music start a band
The Clinic
Velvet Boys
secondary colors
Band of Garage
Playground of the Ancient
Space Dock 1
parker and daron
band 1 to be named
Ryan Eldridge and
The New Shakers
The Sound Clash
Ministry
Antioch Audio Production
The Bhodi Dyin'
Musical
Irish Medieval
Fantastico
Forward
Backward: The Door to Stop
Focus log out

Band Profile

The Jukes

Melodic, Alternative, Rock

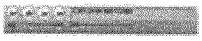

| | | |
|---|---|---|
| The Journal (Unmastered) | 11/30/07 | downloadtracks plays: 236 |
| The Journal (Unmastered) :JBE Records Copyright | | |
| Strange News From Another Star (Unmastered) | 12/29/07 | downloadtracks plays: 242 |
| Strange News From Another Star- JBE Records Copyright | | |
| The Oven And The Open Door | 05/30/08 | downloadtracks plays: 247 |
| It's been too long, collabo with KennelCough (Brendan Lynch of Fashionbox: JBE Records Copyright | | |
| new track | 01/22/08 | downloadtracks plays: 109 |
| NEW track with some short vocals i layed down in the beginning...daron, let me know if it's an up or down. | | |
| Beg (Album Version) | 12/25/07 | downloadtracks plays: 287 |
| -Beg- (Album Version) JBE Records Copyright | | |
| Belong to it | 03/08/08 | downloadtracks plays: 144 |
| some mellow stuff leading in to beatboxing and sound effects. Daron, sorry it's been forever...here's my newest...it's been a long time since i've written anything. you know how it is. | | |
| Twice Removed and a Different Layer (Album Version) | 12/25/07 | downloadtracks plays: 383 |
| Twice Removed and a Different Layer (Album Version) JBE Records Copyright | | |
| Constellations (Album Version) | 11/30/07 | downloadtracks plays: 524 |
| Constellations (Album Version) JBE Records Copyright | | |
| A Natural Disaster | 05/31/08 | downloadtracks plays: 415 |
| Sometimes it rains to much to care. JBE Records Copyright | | |

Members
Daron Whitmore - Acoustic Guitar
Lucy Martier - Acoustic Guitar
Sloan Smith - Electric Bass audition for this band

Comments
What kind of a retard rights this awsome stuff look this is what i Call music!!!!!!!!!!!!!

Posted Sun May 18, 2008 9:54am by Smully

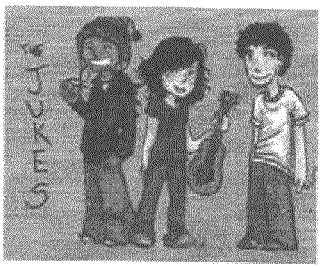

band image gallery

Description
The Jukes is: --Lucy Martier-Vocals, Guitar/--Daron Whitmore-Guitar, Backup Vocals, Synthbeat and Strings/--Sloan Smith- Bass, Backup Vocals, Harmonica

Influences
Metric- Pinback- Gorillaz-Zero 7- Air- The Herbalizer-

Figure 7

Tracks for Song ABC by User 1's Band 1
(The "tracks" page for a given song as accessed from the band profile page)

Click on an item to start (Music Player: This is what the music player actually looks like. In previous pages, its functions are described with words.)

Welcome
User 1

View My Profile
Edit My Profile
Change Password
Manage My Photos
Manage My Music start a band
User 1's Band 1
User 1's Band 2
User 1's Band 3

User 1's Band 1
View Band Profile
Edit Band Profile
Manage Band Photos
Manage Band Music (These are hyperlinks)

Song ABC First Layer.wav dd/mm/yy 12:00 am User 1 download
Song ABC Second Layer.mp3 dd/mm/yy 12:00 am User 2 download (clicking on "Song ABC Second Layer.mp3," for example, will play that music track in the player.)

Choose File no file selected Upload Track (Anyone who is a registered musician can upload a track on this page. Band members can delete that track from the manage band music section or make that track the default track to play in the player on the band profile page. When a user uploads a track, it is added to the list of tracks that are playable in the player on this page.)

Figure 8

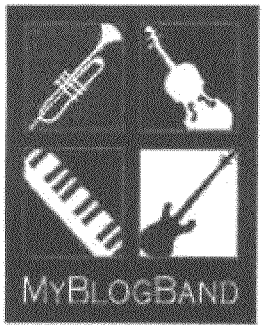

Welcome
powerinthelines!
view my profile
edit my profile
change password
manage my photos
manage my music start a band
The Clinic
Velvet Boys
secondary colors
Band of Garage
Playground of the Ancient
Space Dock 1
parker and daron
band 1 to be named
Ryan Eldridge and
The New Shakers
The Sound Clash
Ministry
Antioch Audio Production
The Bhodi Dyin'
Musical
Irish Medieval
Fantastico
Forward
Backward: The Door to Stop
Focus secondary colors
view band profile
edit band profile
manage band photos
manage band music log out

Tracks for Beltang by secondary colors

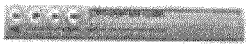

| | | |
|---|---|---|
| beltang.mp3 | 07/05/07 11:07 pm | Parker Emmerson |
| beltang.mp3 | 07/07/07 6:07 pm | Kelven Jinbo |
| beltang.mid | 07/07/07 11:07 pm | Parker Emmerson |

Choose File no file selected Upload Track

Figure 9

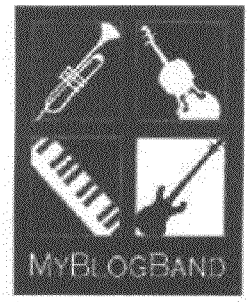

Welcome
powerinthelines!
view my profile
edit my profile
change password
manage my photos
manage my music start a band
The Clinic
Velvet Boys
secondary colors
Band of Garage
Playground of the Ancient
Space Dock 1
parker and daron
band 1 to be named
Ryan Eldridge and
The New Shakers
The Sound Clash
Ministry
Antioch Audio Production
The Bhodi Dyin'
Musical
Irish Medieval
Fantastico
Forward
Backward: The Door to Stop
Focus

The Clinic
view band profile
edit band profile
manage band photos
manage band music log out

Tracks for Zombie by The Clinic

03 Zombie Totter X.mp3 06/25/07 12:06 pm Parker Emmerson download

Choose File no file selected Upload Track

Figure 10

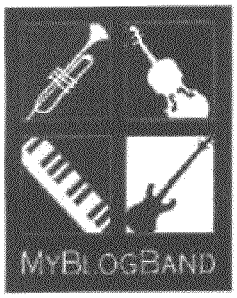

Tracks for On Dew Sun Rising by The Clinic

| | | | |
|---|---|---|---|
| On Dew Sun Rising 1.mp3 | 02/28/08 9:02 pm | Parker Emmerson | download |
| on dew sun rising w. violin.mp3 | 04/06/08 9:04 pm | Robbie Marion | download |

Choose File no file selected Upload Track

Welcome
powerinthelines!
view my profile
edit my profile
change password
manage my photos
manage my music start a band
The Clinic
Velvet Boys
secondary colors
Band of Garage
Playground of the Ancient
Space Dock 1
parker and daron band 1 to be named
Ryan Eldridge and The New Shakers
The Sound Clash Ministry
Antioch Audio Production
The Bhodi Dyin' Musical
Irish Medieval Fantastico
Forward Backward: The Door to Stop Focus

The Clinic
view band profile
edit band profile
manage band photos
manage band music log out

Figure 11

MyBlogband Logo (hyperlinks to homepage)

BANDS MUSICIANS TUTORIAL

Musicians (Musicians Search Page)

Instrument: Any

Genre: Any

Playing for at least years.

State Any (select from a list or enter digits)

Search (clickable button)

Welcome
User 1

View My Profile
Edit My Profile
Change Password
Manage My Photos
Manage My Music start a band
User 1's Band 1
User 1's Band 2
User 1's Band 3

User 1's Band 1
View Band Profile
Edit Band Profile
Manage Band Photos
Manage Band Music (These are hyperlinks)

Figure 13

Welcome
User 1

View My Profile
Edit My Profile
Change Password
Manage My Photos
Manage My Music start a band
User 1's Band 1
User 1's Band 2
User 1's Band 3

User 1's Band 1
View Band Profile
Edit Band Profile
Manage Band Photos
Manage Band Music (These are hyperlinks)

Figure 14

Welcome
User 1

View My Profile
Edit My Profile
Change Password
Manage My Photos
Manage My Music

Figure 15

MYBLOGBAND BANDS MUSICIANS TUTORIAL

MYBLOGBAND

Welcome powerinthelines!
view my profile
edit my profile
change password
manage my photos
manage my music start a band
The Clinic of the Life World Rocker Corps
Velvet Boys
secondary colors
Band of Garage
Playground of the Ancient
Space Dock 1
parker and daron
band 1 to be named
Ryan Eldridge and The New Shakers
The Sound Clash
Ministry
Antioch Audio Production
The Bhodi Dyin' Musical
Irish Medieval Fantastico

Band Profile

The Clinic of the Life World Rocker Corps

Electronica, Rock, Dance

Click on an item to start

Vel 08/15/07downloadtracks plays: 125

A loop of the main riff. more parts need to be created for the chorus and bridge.

Formless Unstructor 08/21/07downloadtracks plays: 108

My Town 12/19/07downloadtracks plays: 237

© Parker Emmerson and The Clinic

Most of the Past is behind Me 06/28/07downloadtracks plays: 351

Most of the past is behind me, most of the future is before me. Can you have a conversation with a photograph? can you read a face like a map?

By the Fountain, It is Cool 08/07/07downloadtracks plays: 161

Techno Lounge 05/03/07downloadtracks plays: 167

©

On Dew Sun Rising 04/06/08downloadtracks plays: 57

Featuring Robbie Marion on violin. Check out his profile and Medieval Fantastico.

Next Tryptych 02/26/09downloadtracks plays: 5

The middle section is really where we could use some serious rocking out on this one. I had some suggestions if you did want to collaborate online in the comment area. I'll try to maybe add some drums if I can find the right set up, but a really shredding guitar could make this one sweet.

Live Love Listen 08/06/07downloadtracks plays: 49 plays:

band image gallery

Description
The first Blogband to grace the web. Welcome, age of creative cyber collaboration. All music © The Clinic, Daron Whitmore, Julian Warren, Parker Emmerson, Lucy Martier, and Nathan Case-McDonald.

Eaters People Purple (Formerly the Clinic) by Parker Emmerson, Lucy Martier, Julian Warren, Daron Whitmore, Nathan Case-McDonald is licensed under a Creative Commons Attribution-Noncommercial-Share Alike 3.0 United States License.

Influences
The Now.

Memorable Shows
For the regulars at the Womb Cave, home of the Clinic

Figure 17

User 1's Band 1
View Band Profile
Edit Band Profile
Manage Band Photos
Manage Band Music (These are hyperlinks)

Figure 18

Manage Band Music

Vel 08/15/07 [edit] [song tracks]
A loop of the main riff. more parts need to be created for the chorus and bridge.
Formless Unstructor 08/21/07 [edit] [song tracks]
My Town 12/19/07 [edit] [song tracks]
© Parker Emmerson and The Clinic
Most of the Past is behind Me 06/28/07 [edit] [song tracks]
Most of the past is behind me, most of the future is before me. Can you have a conversation with a photograph? can you read a face like a map?
By the Fountain, it is Cool 08/07/07 [edit] [song tracks]
Techno Lounge 05/03/07 [edit] [song tracks]
©
On Dew Sun Rising 04/06/08 [edit] [song tracks]
Featuring Robbie Marion on violin. Check out his profile and Medieval Fantastico.
Next Tryptych 02/26/09 [edit] [song tracks]
The middle section is really where we could use some serious rocking out on this one. I had some suggestions if you did want to collaborate online in the comment area. I'll try to maybe add some drums if I can find the right set up, but a really shredding guitar could make this one sweet.
Live Love Listen 08/06/07 [edit] [song tracks]
B ackspace 03/15/08 [edit] [song tracks]
A little banjo diddy. This was the first recording, so it can be executed better, but I just wanted to get it recorded. © Julian Richard Warren
Ivan Opus Scott II 04/09/07 [edit] [song tracks]
©
Domino 09/03/07 [edit] [song tracks]
some ideas. daron plays a sweet drum beat to this.
Nutmeg 12/28/07 [edit] [song tracks]
Has some room for other instruments. Sax or violin may be added at a later date.
The Whirlship 04/10/07 [edit] [song tracks]
Looking for somebody to try some vox on top.
Crazy Man 02/12/09 [edit] [song tracks]
Playground of the Ancient 03/31/08 [edit] [song tracks]

Figure 19

Song JKL dd/mm/yy [edit] [song tracks]

This is a space for band members to post comments about the song
This space accepts user HTML and is accessed by clicking "[edit]".

Figure 22

MYBLOGBAND BANDS MUSICIANS TUTORIAL

MYBLOGBAND

Welcome powerinthelines!
view my profile
edit my profile
change password
manage my photos
manage my music start a band
The Clinic of the Life World Rocker Corps
Velvet Boys
secondary colors
Band of Garage
Playground of the Ancient
Space Dock 1
parker and daron band 1 to be named
Ryan Eldridge and The New Shakers
The Sound Clash Ministry
Antioch Audio Production
The Bhodi Dyin' Musical
Irish Medieval Fantastico

Band Profile

The Jukes

Melodic, Alternative, Rock

Click on an item to start

Beg (Album Version) 12/25/07downloadtracks plays: 409
-Beg- (Album Version) JBE Records Copyright The Journal (Unmastered) 11/30/07downloadtracks plays: 259
The Journal (Unmastered) :JBE Records Copyright Strange News From Another Star (Unmastered) 12/29/07downloadtracks plays: 262
Strange News From Another Star- JBE Records Copyright The Oven And The Open Door 05/30/08downloadtracks plays: 263
It's been too long, collabo with KennelCough (Brendan Lynch of Fashionbox: JBE Records Copyright Belong to it 03/08/08 tracks plays: 191
some mellow stuff leading in to beatboxing and sound effects. Daron, sorry it's been forever...here's my newest...it's been a long time since i've written anything. you know how it is.

A Natural Disaster 05/31/08downloadtracks plays: 523
Sometimes it rains to much to care. JBE Records Copyright Patterns of the world 01/14/09downloadtracks plays: 15
Really rough...i need to come up with another verse or something. i was also sick when recording so my voice is funny but i sorta like it Twice Removed and a Different Layer (Album Version) 12/25/07downloadtracks plays: 774
Twice Removed and a Different Layer (Album Version) JBE Records Copyright Constellations (Album plays:

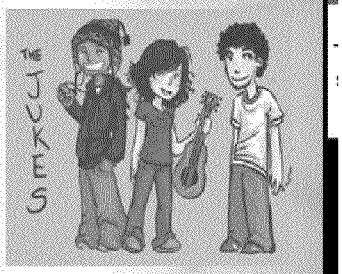

band image gallery

Description
The Jukes is: --Lucy Martier- Vocals, Guitar/--Daron Whitmore-Guitar, Backup Vocals, Synthbeat and Strings/--Sloan Smith- Bass, Backup Vocals, Harmonica

Influences
Metric- Pinback- Gorillaz- Zero 7- Air- The Herbalizer-

Figure 28

MYBLOGBAND BANDS MUSICIANS TUTORIAL

MYBLOGBAND

Welcome powerinthelines!
view my profile
edit my profile
change password
manage my photos
manage my music start a band
The Clinic of the Life World Rocker Corps
Velvet Boys
secondary colors
Band of Garage
Playground of the Ancient
Space Dock 1
parker and daron
band 1 to be named
Ryan Eldridge and The New Shakers
The Sound Clash
Ministry
Antioch Audio Production
The Bhodi Dyin'
Musical
Irish Medieval
Fantastico

Tutorial

MyBlogBand.com is a great way for musicians to connect to other musicians online and exchange music and ideas. It is also a great way for listeners to discover new bands and musicians they might like as they can search for bands and musicians by genre. Several bands and musicians are featured on the home page, and the most played songs are listed in on the home page.

Registration

To participate in MyBlogBand.com, a user must register. To register, a user must enter a username, email and password. If the username or email are already in use, the user must pick another. Once registered, the user is logged in and can post comments to a band page. They also may continue on to become musicians. Any registered user can post comments on the band profile page.

Musicians

Musicians can fill out a profile, post pictures and tracks for others to listen to. Any of this can be edited at any time by logging in. Musicians may also participate in bands by starting a band and inviting other musicians to join, or auditioning for one of the many bands already on the site. To log in, enter your username and password in the log in boxes at the left hand column. If you've forgotten your password, you may click on "email me my password" and your password will be mailed to your email address. Once logged in, the log in box goes away, and a menu with various options appears in the left hand column. If you did not create a musician profile when you registered, you can create one now. If you have already created a musicians profile, you can view your profile by clicking on "view profile". You can make changes to or delete your profile by clicking on "edit my profile". It is important to choose genres that represent your music, as that will help others with similar interests find you. It is also important to choose instruments that you play, the amount of time you have been playing that instrument, and the state you live in as this information will be used by other musicians on the site to find you.

You can change your password by clicking on the "change my password" link in the left hand column. You can add and remove images from your image gallery by clicking on "manage my images". Images are uploaded by selecting a local file using the "Browse" button and then clicking "Upload".

Figure 29 manage my music start a band
The Clinic of the Life World Rocker Corps
Velvet Boys
secondary colors
Band of Garage
Playground of the Ancient
Space Dock 1
parker and daron
band 1 to be named
Ryan Eldridge and The New Shakers
The Sound Clash
Ministry
Antioch Audio Production
The Bhodi Dyin' Musical
Irish Medieval Fantastico
Forward Backward: The Door to Stop Focus
123...∞
Lucid Troubador
Technicolor Marker
Roy Cordial and The Sodas
Rockers of the Lifeworld Core
Rainbow High log out Ads by Google
Band
Thousands Of Professional

Musicians

Musicians can fill out a profile, post pictures and tracks for others to listen to. Any of this can be edited at any time by logging in. Musicians may also participate in bands by starting a band and inviting other musicians to join, or auditioning for one of the many bands already on the site. To log in, enter your username and password in the log in boxes at the left hand column. If you've forgotten your password, you may click on "email me my password" and your password will be mailed to your email address. Once logged in, the log in box goes away, and a menu with various options appears in the left hand column. If you did not create a musician profile when you registered, you can create one now. If you have already created a musicians profile, you can view your profile by clicking on "view profile". You can make changes to or delete your profile by clicking on "edit my profile". It is important to choose genres that represent your music, as that will help others with similar interests find you. It is also important to choose instruments that you play, the amount of time you have been playing that instrument, and the state you live in as this information will be used by other musicians on the site to find you.

You can change your password by clicking on the "change my password" link in the left hand column. You can add and remove images from your image gallery by clicking on "manage my images". Images are uploaded by selecting a local file using the "Browse" button and then clicking "Upload". Only jpeg images should be uploaded. Images can be reordered by using the pulldown boxes next to each image and selecting which position you would like that image to occupy. The first image is used as the thumbnail image for your musicians profile page, so choose an image that you like. You can add and remove tracks from your profile by clicking on the "manage my tracks" link. Tracks can be uploaded by selecting the file using the "Browse" button and then clicking on the "Upload" button. Depending on the type of connection you have, it may take several minutes to upload a track. Do not click on anything else while a track is uploading. Only MP3 tracks will be playable by the online player. Tracks must be named before they are uploaded.

Bands

Musicians can participate in bands in several ways. A musician may start a band. A band has a profile very similar to the musician profile. It is important to choose genres that are representative of this band so other musicians and listeners can find the band. Bands also have image galleries that work identically to the Musician image gallery described above. Once a musician creates a band, they can invite other musicians to join the band by searching for them using the "Musicians" menu item at the top of the page.

Figure 30 log out

Ads by Google

Band
Thousands Of Professional Bands & Musicians For Weddings And Parties
www.GigMasters.com Meet Local Musicians
Free Profile - Bands & Artists Thousands of Listings - Pics, MP3
www.BandMix.com Can you Sing?
Post your stuff to get gigs. Free. Connect with music professionals!
www.TALTOPIA.com Bands Seeking Musicians
Explore 1000s of Openings For Bands Seeking Musicians At Explore Talent
www.ExploreTalent.com

Bands

Musicians can participate in bands in several ways. A musician may start a band. A band has a profile very similar to the musician profile. It is important to choose genres that are representative of this band so other musicians and listeners can find the band. Bands also have image galleries that work identically to the Musician image gallery described above. Once a musician creates a band, they can invite other musicians to join the band by searching for them using the "Musicians" menu item at the top of the page.

If you have at least one band, and the musician is not in that band, a link will show up on that musicians profile page called "invite this musician to join your band". This will open a page where you select the band that you want to invite them to join and an optional message. An email will be sent to the invited musician. They can log in and accept your invitation. Band members should create at least one song that is representative of the band. This is done by clicking on the band name in the left hand column and then clicking on "manage band music". This will open a page where any current songs are listed, and a link to add a new song is available. Add a new song by clicking on the "add a new song" link and filling in a title and optional description. Once the song is created, tracks can be uploaded for this song. A song may have many tracks as the song develops and new parts are added. Tracks are added by clicking on the "tracks" link under the song on the "manage band music" page. Select a local file using the "Browse" button and then click "Upload". Please wait for the upload to complete as it may take some time depending on the type of internet connection you have. The first track uploaded becomes the "public" track for this song and is the one that shows up on the band profile page for this song. You can add notes for this track so that others know what the track is. You can make this a "private" track so that only other band members can see it, and you can decide if you want to make it downloadable by others.

As more tracks are uploaded, you can decide which one is the "public" track. For instance, if you add a guitar solo to the song, you can upload a mix that includes this solo and make that the "public" track. Any musician can audition for any band that they are not already in. To do this, find a band using the "Bands" menu item at the top of the page, and click on the "audition for this band" link. This will allow you to upload a track for a song. The band members will get an email. A band member can log in, find the band and song that the musician has auditioned for, and listen to the track. The band members can keep the track or delete it. If they like the musician, they can invite them to join the band by clicking on their name and clicking on "invite this musician to join your band" on the profile page as described above.

Figure 32

123...∞
Lucid Troubador
Technicolor Marker
Roy Cordial and The Sodas
Rockers of the Lifeworld Core
Rainbow High log out Ads by Google Remove Vocals Like Magic.
Remove vocals from music, songs, CDs, MP3s. Download Instantly!
www.Make-Your-Own-Ka Karaoke Voice Removal
Software That Removes Vocals From Your CDs and MP3s. Instant Download
www.MakeKaraokeTrack

Members
Daron Whitmore - Acoustic Guitar
Lucy Martier - Acoustic Guitar
Bryan Smith - Acoustic Guitar audition for this band

Comments

What kind of a retard rights this awsome stuff look this is what i Call music!!!!!!!!!!!!!!

Posted Sun May 18, 2008 9:54am by Smully

Wow i heard your guys song (belong to it) and was amazed by the voice. Keep it up you guys.

Posted Sat Mar 29, 2008 10:57pm by esteban0112

Posted Sat Mar 29, 2008 10:56pm by esteban0112 this song is beautiful lucy. i want to do some works on the ending if you don't mind. i will see you soon, hopefully Posted Wed Mar 12, 2008 2:20am by Daron Hey, you guys have some pretty cool music. Ever thought about live drums?

Posted Thu Jan 31, 2008 7:52am by SGarrettDrums post the song with the new violin track!

Posted Sun Jan 27, 2008 9:28pm by Lucy Martier

Hey lucy, i listened to what you have so far and i really like it (radiohead) feeling. But i don't think it

Figure 33

I'm on the beach at Ipanema in Rio listening to this Samba in the background. It's just great.
Posted Sat Aug 11, 2007 3:32pm by powerinthelines Hey Daron, Check out someone's coming down the stairs, it's in space dock 1.
Posted Wed Aug 8, 2007 11:14pm by powerinthelines I'm really excited to see what comes next!
Posted Mon Jul 30, 2007 1:17am by Evan Deary daron,
you should definantly post that rough draft.
Posted Thu Jul 19, 2007 8:25pm by Lucy Martier we have a few more tracks we are putting together, they should be on here shortly
Posted Tue Jul 17, 2007 8:57pm by Daron wow, i really like that.
have you guys done anything else?
Posted Thu Jul 12, 2007 5:13pm by necm Nice song guys, I can't wait to hear the final mix.
Posted Sat Jul 7, 2007 10:41pm by CaptainN i really like your song. good quality
Posted Thu Jun 28, 2007 8:27pm by Kelven Post a comment:

Post

About MyBlogBand Terms of Use Privacy Report Abuse Copyright

Figure 35

MYBLOGBAND BANDS MUSICIANS TUTORIAL

Please Support Our Sponsors

ADster
The new way to buy & sell flat-rate text ads!
Advertise Here

MYBLOGBAND

Welcome powerinthelines!
view my profile
edit my profile
change password
manage my photos
manage my music start a band
The Clinic of the Life World Rocker Corps
Velvet Boys
secondary colors
Band of Garage
Playground of the Ancient
Space Dock 1
parker and daron band 1 to be named
Ryan Eldridge and The New Shakers
The Sound Clash
Ministry
Antioch Audio Production
The Bhoci Dyin' Musical
Irish Medieval

Musician Profile

Parker Emmerson
username: powerinthelines
age: 21
AOL screen name: powerinthelines
Chapel Hill, NC

Primary Instrument
Piano for 16 years
Secondary Instrument
Acoustic Guitar for 5 years
Additional Instrument
Drums for 6 years
Genre
Rock , Electronica , Classical Click on an item to start

| | |
|---|---|
| Uniykwood, Composition in 3 Continuous Movements<br>© Parker Emmerson | 07/11/08 12:07 pm |
| Handsong<br>© Parker Emmerson | 07/10/08 2:07 pm |
| Sterographix<br>© Parker Emmerson | 07/10/08 3:07 pm |
| Blvd. St. Germain<br>© Parker Emmerson | 07/11/08 12:07 pm |
| Winter Storm<br>© Parker Emmerson | 07/10/08 3:07 pm |
| The Dark Pine Forest<br>© Parker Emmerson | 07/11/08 12:07 pm |
| Improvisation no. 2 movement 2<br>© Parker Emmerson | 07/11/08 12:07 pm |
| Lying in the Snow<br>© Parker Emmerson | 07/10/08 3:07 pm |

my image gallery

Background
I've been playing classical piano for 16 years (Chopin, Satie, Debussy, Khachaturian, Messiaen). I've been composing music since I was 8. During high school, I was in a rock-synth band called The Clinic. Now we are a cyberband and play together whenever we are in town.

Influences
Classical, John Cage, Steve Reich, The Beatles.

Gear
Yamaha S80 Synth, Reason, Audacity.

__MSG_title__

You are not currently logged into Google Talk.
Sign In

Figure 36

MYBLOGBAND BANDS MUSICIANS TUTORIAL

MYBLOGBAND

Welcome powerinthelines!
view my profile
edit my profile
change password
manage my photos
manage my music start a band
The Clinic of the Life World Rocker Corps
Velvet Boys
secondary colors
Band of Garage
Playground of the Ancient
Space Dock 1
parker and daron band 1 to be named
Ryan Eldridge and The New Shakers
The Sound Clash
Ministry
Antioch Audio Production
The Bhodi Dyin' Musical
Irish Medieval Musician Profile Parker Emmerson
username: powerinthelines
age: 21
AOL screen name: powerinthelines
Chapel Hill, NC Primary Instrument
Piano for 16 years
Secondary Instrument
Acoustic Guitar for 5 years
Additional Instrument
Drums for 6 years
Genre
Rock , Electronica , Classical Click on an item to start

| | |
|---|---|
| Uniykwood, Composition in 3 Continuous Movements © Parker Emmerson | 07/11/08 12:07 pm |
| Handsong © Parker Emmerson | 07/10/08 2:07 pm |
| Sterographix © Parker Emmerson | 07/10/08 3:07 pm |
| Blvd. St. Germain © Parker Emmerson | 07/11/08 12:07 pm |
| Winter Storm © Parker Emmerson | 07/10/08 3:07 pm |
| The Dark Pine Forest © Parker Emmerson | 07/11/08 12:07 pm |
| Improvisation no. 2 movement 2 © Parker Emmerson | 07/11/08 12:07 pm |
| Lying in the Snow © Parker Emmerson | 07/10/08 3:07 pm |

my image gallery

Background
I've been playing classical piano for 16 years (Chopin, Satie, Debussy, Khachaturian, Messiaen). I've been composing music since I was 8. During high school, I was in a rock-synth band called The Clinic. Now we are a cyberband and play together whenever we are in town.

Influences
Classical, John Cage, Steve Reich, The Beatles.

Gear
Yamaha S80 Synth, Reason, Audacity.

__MSG_title__

You are not currently logged into Google Talk.
Sign In

Please Support Our Sponsors
ADster
The new way to buy & sell flat-rate text ads!
Advertise Here

Figure 39

Comments www.adrialdesigns.com <--- Baller this is aidens brother, ask for a quote. it would be a good idea on your part for the site.

Posted Fri Dec 19, 2008 5:58pm by Daron [delete this comment]

Hells yeah, done and done!

Posted Thu Sep 18, 2008 11:59pm by Strangewaste [delete this comment]

i want to edit the unsolved piece when i see you again - let me compact and rearrange. i think it would be premature to publish it now as it's interspersed with raw material. the vocals are legendary at times. while still sounding distinctly you, a few lines remind me of david bowie and the talking heads, and later of pink floyd. along with

METHODS FOR ONLINE COLLABORATIVE MUSIC COMPOSITION

BACKGROUND OF THE INVENTION

1. Field of the Invention

The present invention relates generally to online music collaboration. Further, the present invention relates to methods for providing collaborative music compositions via a computer network.

2. Description of the Prior Art

It is known in the relevant art to provide for online music uploading and downloading. However, typically this is done for completed musical compositions. Some web-based options provide for musicians to collaborate on projects, but do not provide for collaborative groups or virtual bands. These sites provide for only one single track to be uploaded, not multiple tracks at the same or similar time from the same collaborative group. By way of example, this might be a guest artist performing with an existing band on one track. Thus, there remains a need for online, collaborative group music compositions for multiple tracks. Also there remains a need for selective grouping and multiple group collaborations on an ongoing basis with these methods.

SUMMARY OF THE INVENTION

A first aspect of the present invention is to provide methods for creating and editing collaborative music compositions via a computer network, including remote uploading tracks by musicians. Another aspect of the present invention provides methods for creating and joining a band, at least one musician to join a virtual group of at least one other musician for the purpose of virtual collaborative creating and/or editing music tracks remotely, via an online network and interactive website therefor.

These and other aspects of the present invention will become apparent to those skilled in the art after a reading of the following description of the preferred embodiment when considered with the drawings, as they support the claimed invention.

BRIEF DESCRIPTION OF THE DRAWINGS

The attached FIGS. 1*b* and 2-11 illustrate screen shots of graphic user interface (GUIs) views of web-based interfaces as described hereinbelow.

FIGS. 12-30 illustrate screen shots of GUIs showing aspects of the interactive website for systems and methods of the present invention.

FIGS. 31-40 illustrate screen shots of GUIs showing aspects of the interactive website for systems and methods of the present invention, with substantive illustration of virtual band and musician aspects in particular.

DETAILED DESCRIPTION

Figure 1A:
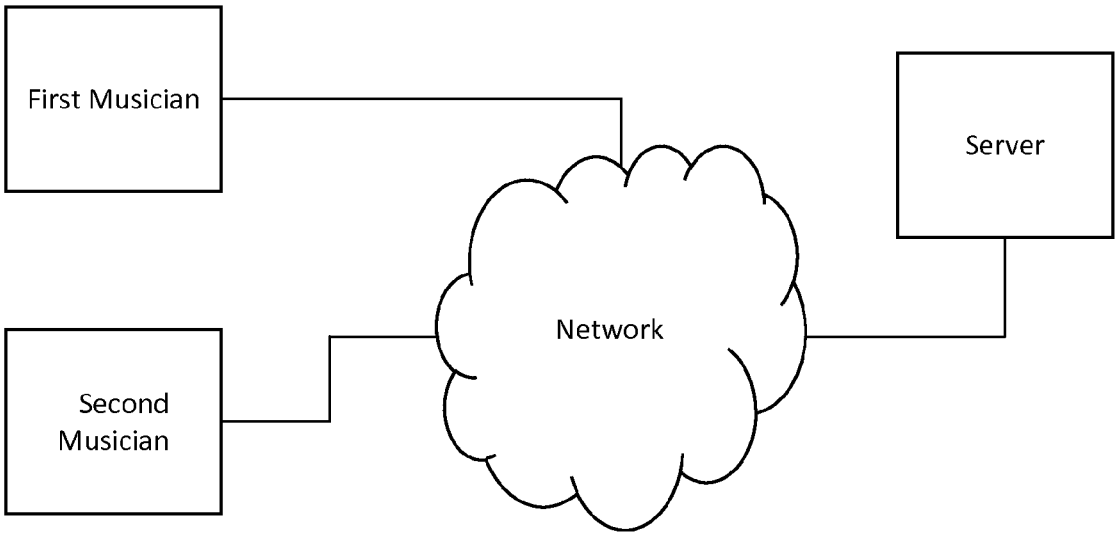
FIGS. 1*a* and 41 illustrate an example system according to the present invention. The attached

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

The present invention provides a method for creating and editing collaborative music compositions via a computer network, including remote uploading tracks by musicians. Additionally, the present invention provides methods for creating and joining a band, at least one musician to join a virtual group of at least one other musician for the purpose of virtual collaborative creating and/or editing music tracks remotely, via an online network and interactive website therefor.

The present invention provides for automated systems for providing online music composition including: an interactive website accessible from a remote computer device via a network, the website being operable for receiving a first track uploaded through the network from a first remote source, the first track created by at least one musician entity; the website further operable for automatically saving and categorizing the at least one track according to the musician entity and a music genre; the website further operable for receiving a second track from a second remote source, the second track created by a second musician entity, selectively combining the first track and the second track, and saving the combined tracks for creating a collaborative music composition. Preferably, the system is accessible remotely via a multiplicity of musician entities for uploading, editing, and creating collaborative music compositions selectively with other musician entities; remote access is based upon user accounts for the musician entities and their corresponding virtual bands, when they exist.

The website is operable to provide for any of the musician entities to access and edit the collaborative music composition via network connection to the interactive website.

Furthermore, the present invention provides for methods for providing online music composition including the steps of: providing an interactive website accessible with a remote computer via a network, wherein the website is operable for receiving a first track from a first remote source, the first track being created by at least one musician entity, saving and categorizing the at least one track according to musician and genre, receiving a second track from a second remote source, the second track created by a second musician entity, selectively combining the first track and the second track, and saving the combined tracks for creating a collaborative music composition.

Also the present invention provides for methods for online music collaboration including the steps of: providing an interactive website accessible with at least one remote computer device via a network, wherein the website is operable for receiving a first track from a first remote source, the first track being created by at least one musician entity, saving and categorizing the at least one track according to musician and genre, receiving a second track from a second remote source, the second track created by a second musician entity, selectively combining the first track and the second track, and saving the combined tracks for creating a collaborative music composition; and wherein the musician entities are self-selectively combinable to form at least one virtual band for online music creation, editing, and social network-based distribution through the interactive website.

The methods further include the steps of editing the combined tracks, and the interactive website is operable for receiving a multiplicity of tracks from more than one remote musician entity. Advantageously, the interactive website system and methods of the present invention are operable for automatically categorizing the virtual bands based upon a track categorization of composite tracks and/or based upon a musician categorization of any or all of the at least one musician entities that contribute at least one track to the composite track.

Referring now to the drawings in general, the illustrations are for the purpose of describing a preferred embodiment of the invention and are not intended to limit the invention thereto. For the purpose of this application, a "track" is defined as and refers to a music track. Typically, according to the present invention, music tracks are composed and produced by at least one musician, often a single musician, who is one of the users of the web-based methods of providing online collaborative music compositions, wherein the musician uploads his/her track to the site via an interactive website accessible through a graphic user interface viewable on a display, the display constructed and configured for interactive user inputs and audiovisual outputs through a computer device, such as a computer having access to the website via a network, such as the Internet, categorizing the track within at least one genre selection on the interactive website.

Regarding methods for the present invention, a web-based graphic user interface (GUI) is provided with interactive functionality so that a user can enter information personally related to himself/herself. First, a user provides a login using a user identification (user ID) and password, to create a user profile and/or account. The user profile may include a musician profile and/or a listener profile. After registration, in one embodiment of the present invention, the user can view music available for review and/or download from the website, and create user-specific playlists. Each track of music available on the website may be selectively included on a given user profile, so that a user may build his/her own playlist(s). The user can visit a band's webpage within the site, review a song and then click-select to add it to his/her playlist. Also, he/she can choose which playlist to add to, in the case of multiple playlists. However, optionally, a user can selectively add another user's entire playlist and/or a band or musician's playlist based upon music that is available for download. In this manner, listener users become distributors for the music. Downloading is preferably based on a pay-per-download basis, with proceeds being distributed to the contributors, including individual musicians from virtual bands. Alternatively, another fee may be paid for downloading another user's playlist in its entirety.

In the methods of the present invention, musician users on the site start a band. That initial band member user can then go directly to other musicians' pages on the site and invite them to join that band. Alternatively or additionally, musicians can go to band pages on the site and audition to join by uploading a track for the band to review. The band receives an automatic notification of the audition track upload and reviews it. The band can then accept or reject the auditioning musician and send a notification of that selection. If accepted, then the new musician can upload tracks that are optionally integrated with existing tracks of the band. At any time an existing band member can upload a track for review by the band and/or for integration to provide a new song based on the integration. The created track that is uploaded can be provided or layered on top of an existing song or other tracks by the band members. Preferably, a musician must initiate a new band and then grow the band as set forth hereinabove. However, notably, musicians can be members of multiple bands or groups for ongoing collaborative music creation through the site. The band members can then invite other musicians to join the band through the site, request auditions from other musicians on the site, and/or receive unsolicited auditions through the site. Importantly, the musicians do not need to ever be in proximity or create the final song contemporaneously; rather, the collective contributions through the site over time create the final songs that are sold through the site to listener members. Also, there can be multiple tracks within one song, and multiple versions of a song, wherein each version has a different combination of tracks provided collaboratively through the site from the same or different musicians.

The present invention is illustrated by the interactive website for www.myblogband.com, which includes an Internet application with a specific functionality for providing virtual collaboration for musicians for creating and editing composite music tracks from a multiplicity of remote musician entities. This interactive website application is operable to provide users with the ability to create and/or join a band remotely from the other musicians in the band, by accessing the site for collaboration via a network, such as the Internet in a virtual workspace for multiple users. The systems and methods of the present invention, including the application, provide for the interactive website for remote users to start a band, invite others to join a band, maintain privacy on tracks by allowing or disallowing download of the song, create files called songs, upload multiple working versions of a song into that file, and select which track is displayed in the player on their band page on the interactive website. The website application also provides for each user or musician (or musician entity) in the band to invite other members to join the band (and thereby have access to all the tracks and uploads of other members of the band). According to one embodiment of the present invention, anyone on the site can also audition to be in a band (including uploading a track to a work in progress of a band of which they are not already a member). Any musician who is a member of the interactive website, for example as illustrated on Myblogband.com, can upload a track to a song file created by a band. Their file is stored with their name on it as the person who uploaded it and displayed on the tracks page, but the band does not necessarily have to use it. Throughout myblogband.com, the spaces allows html code posting.

On a band's page within the site, where multiple versions or tracks of a song exist, the band can select a default track to be listed on the webpage. Any track can be designated private or public by the band or a musician, thereby making it automatically non-downloadable or downloadable, respectively.

Figure 1B:
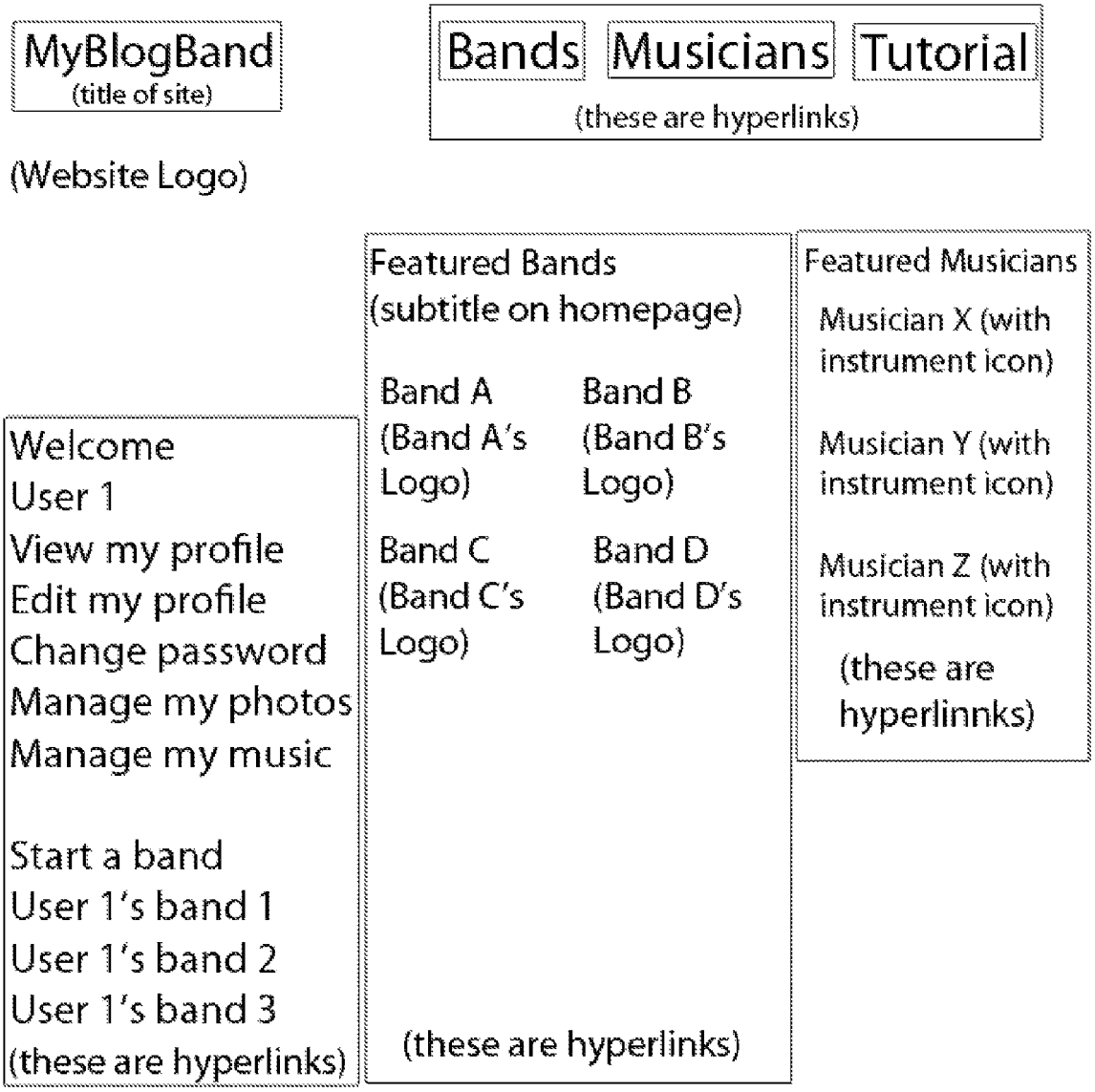

Referring now to the drawings specifically, FIG. 1 provides a GUI for a home page for a website operating according to one embodiment of the present invention. It provides several interactive options for users who visit the site, including profile creation, editing, and review options, which are illustrated here on the left side column. It also provides for any registered musician to start a band; band listings that provide for links to band web pages within the site are provided thereinbelow. Featured bands are listed at the central portion of the screen shot, and featured musicians on the right side.

Figure 3:
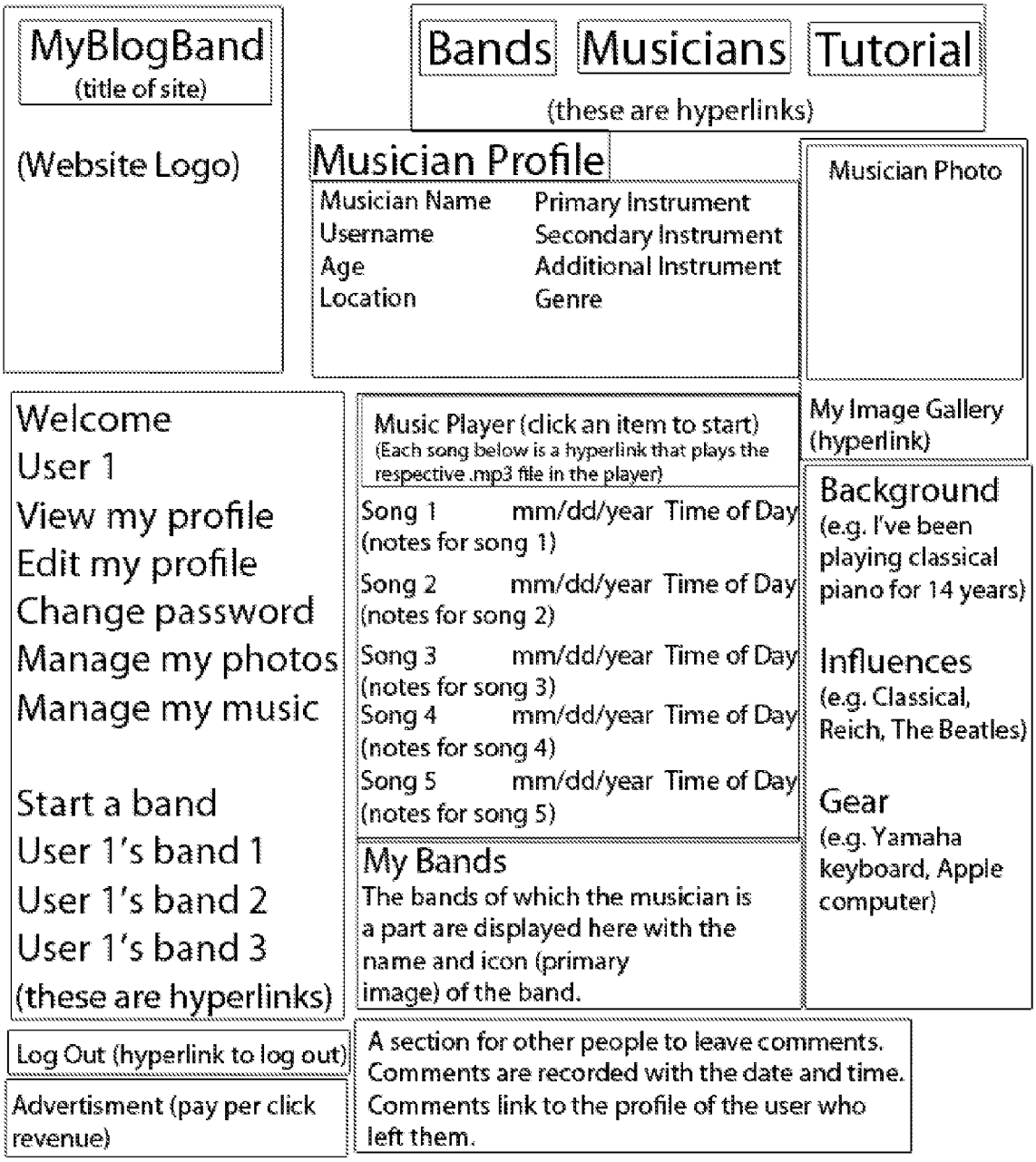
Figure 12:
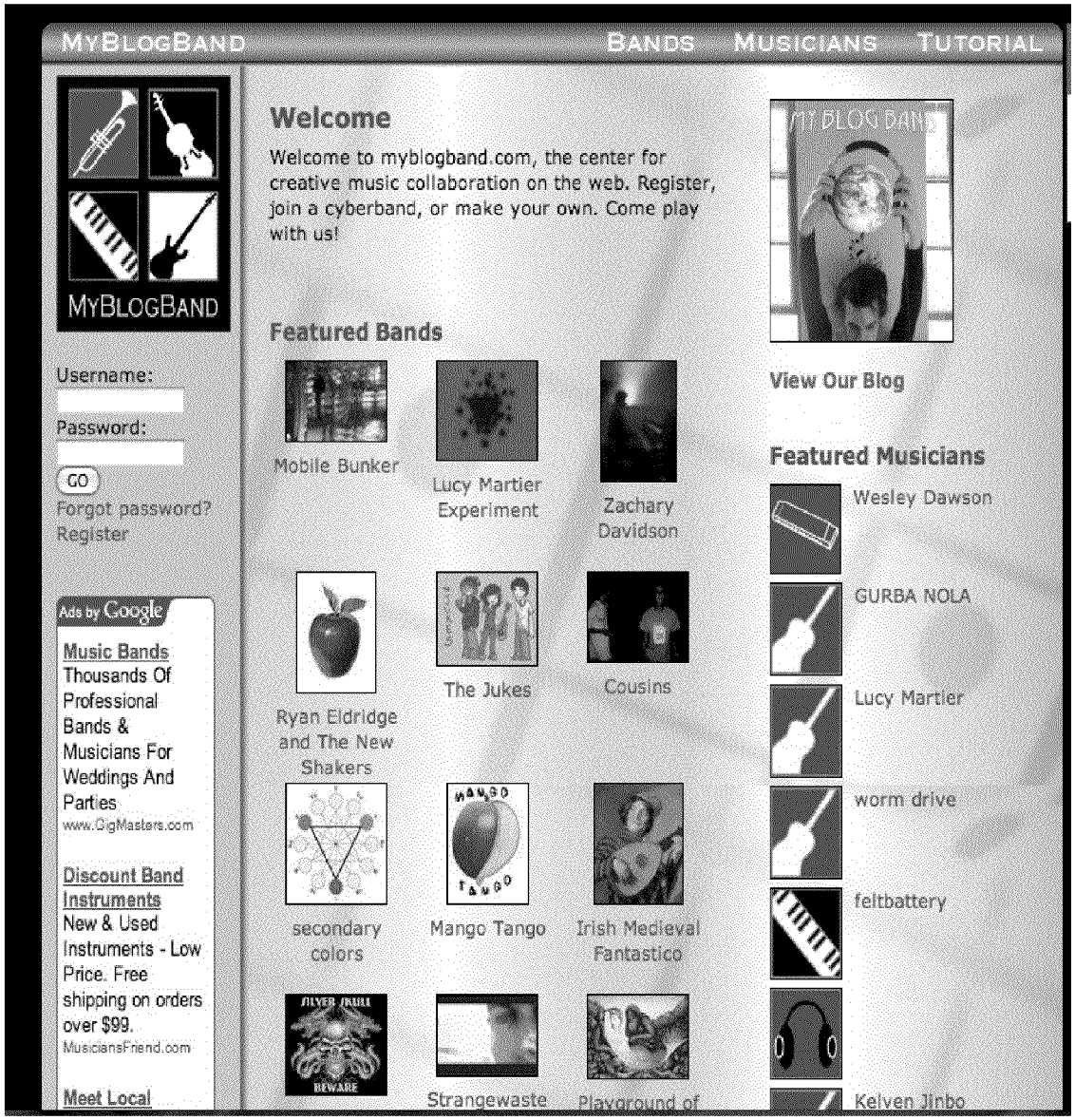
Figure 16:
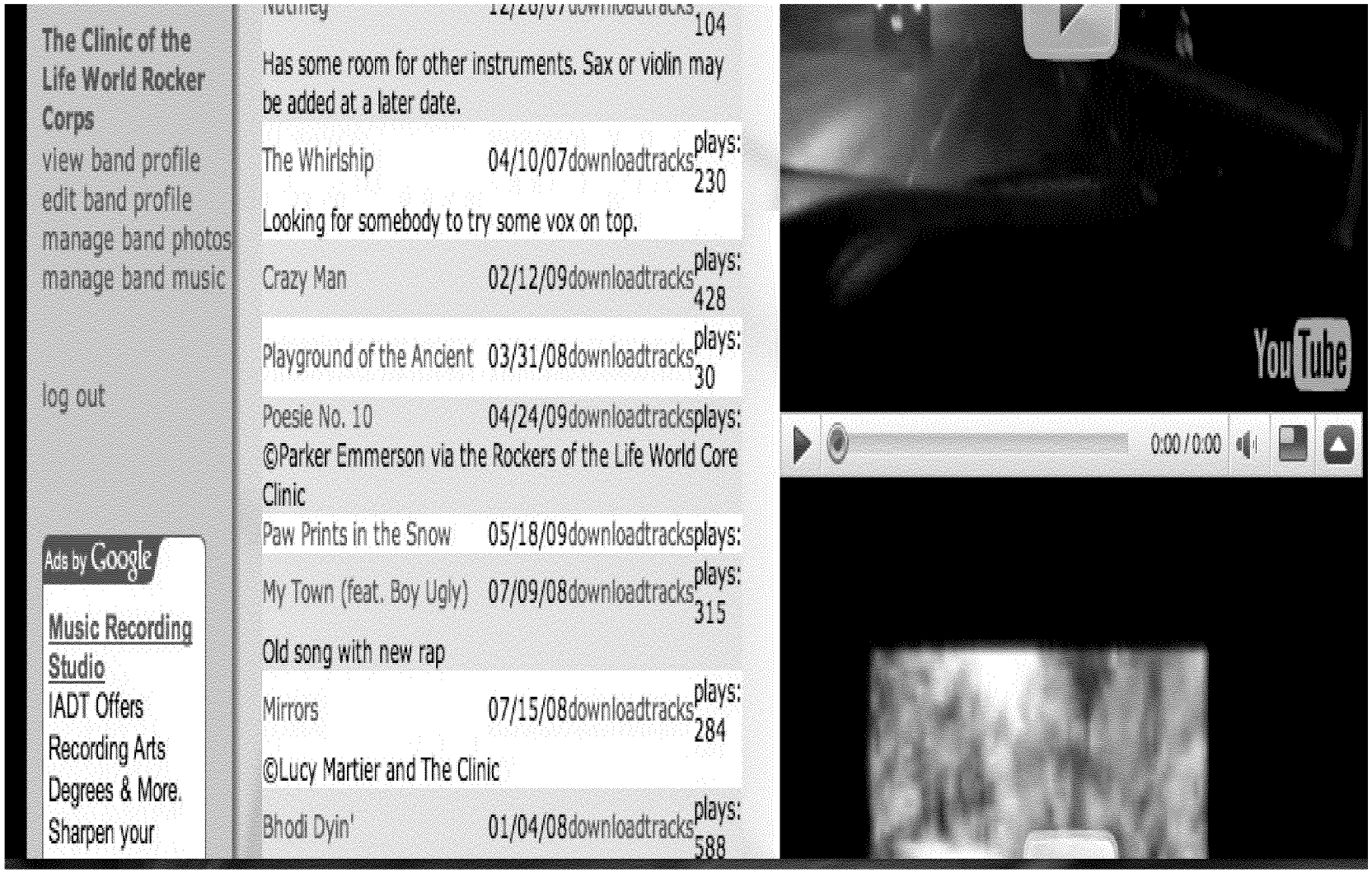
Figure 20:
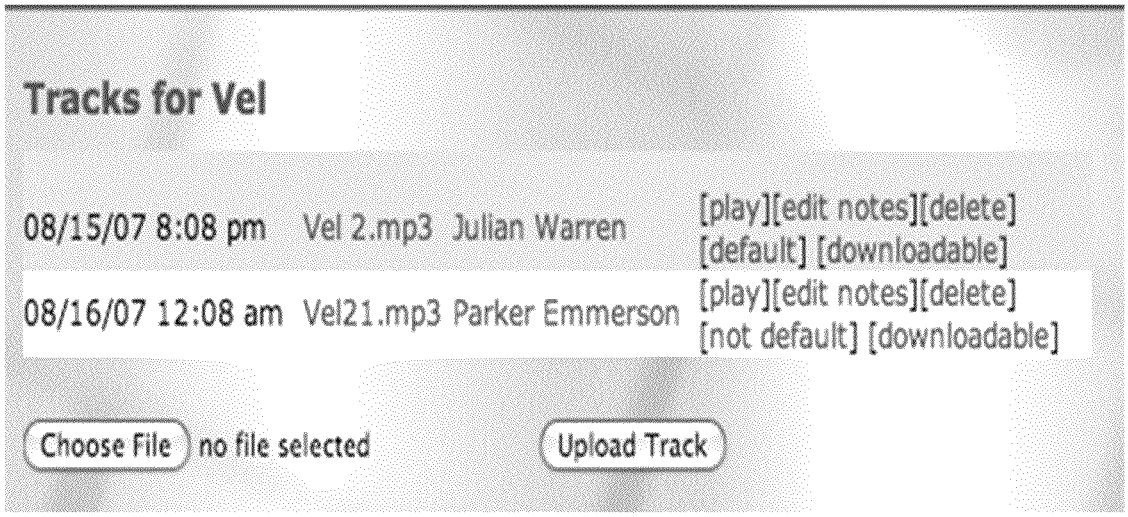
Figure 21:
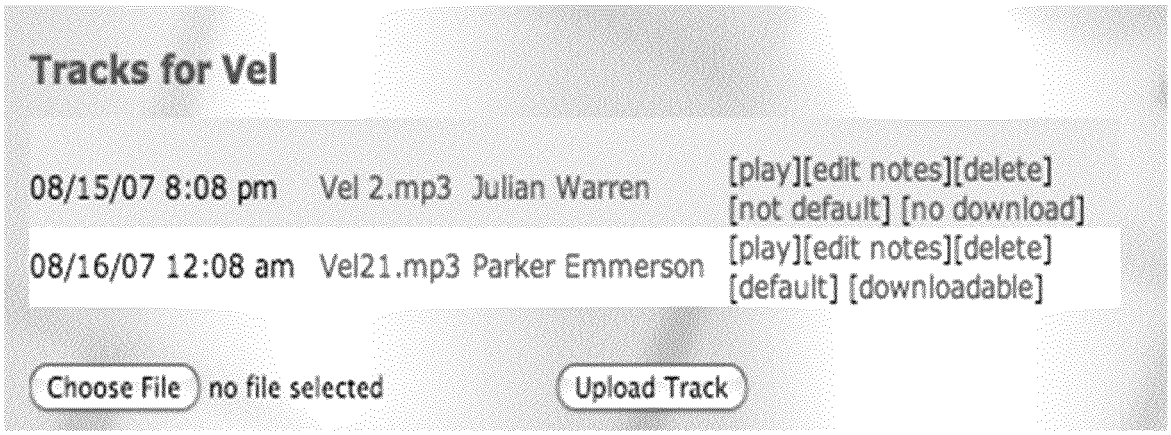
Figure 23:
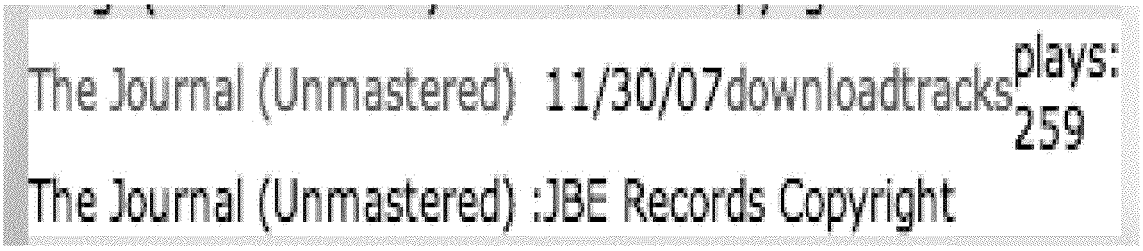
Figure 24:
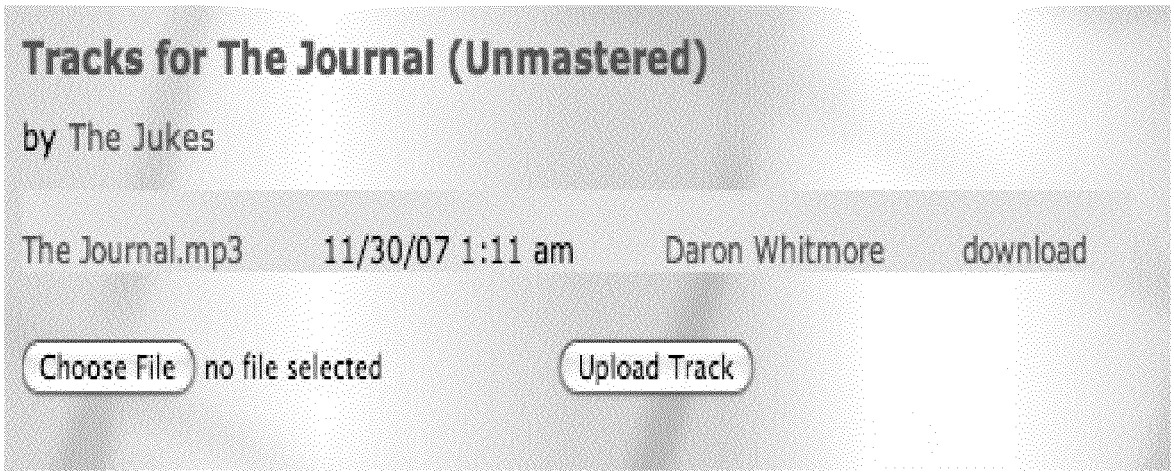
Figure 25:
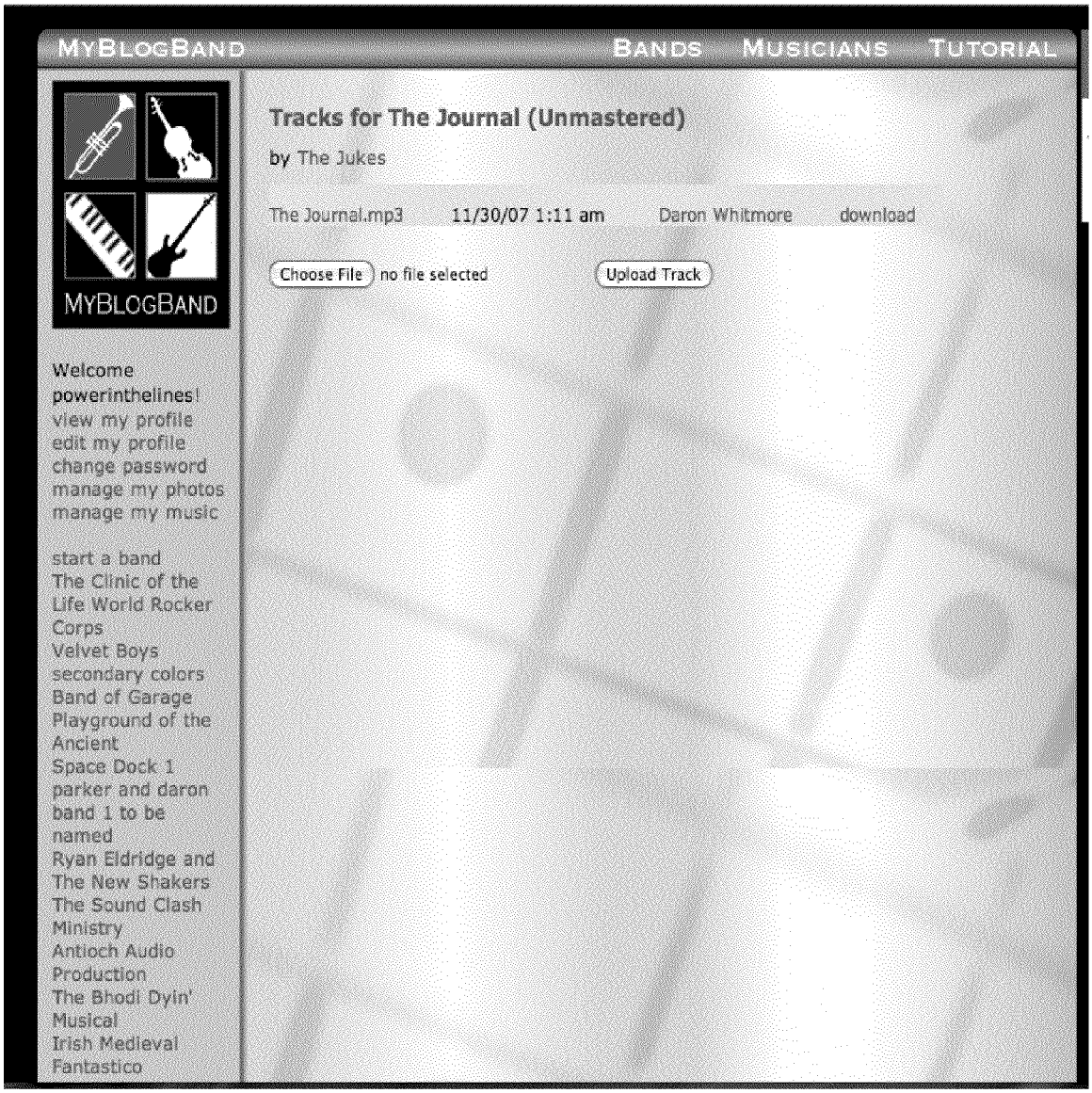
Figure 26:
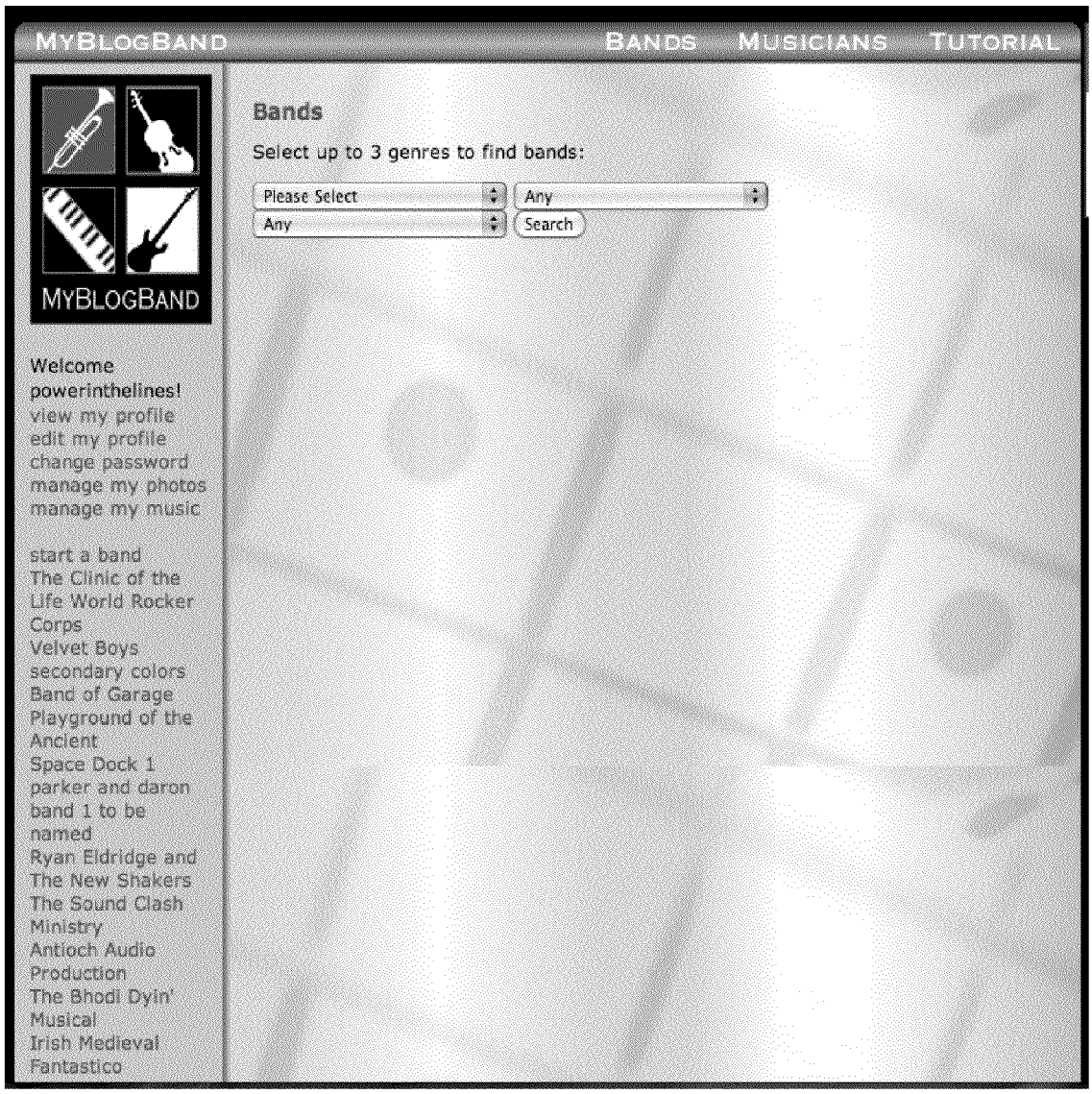
Figure 27:
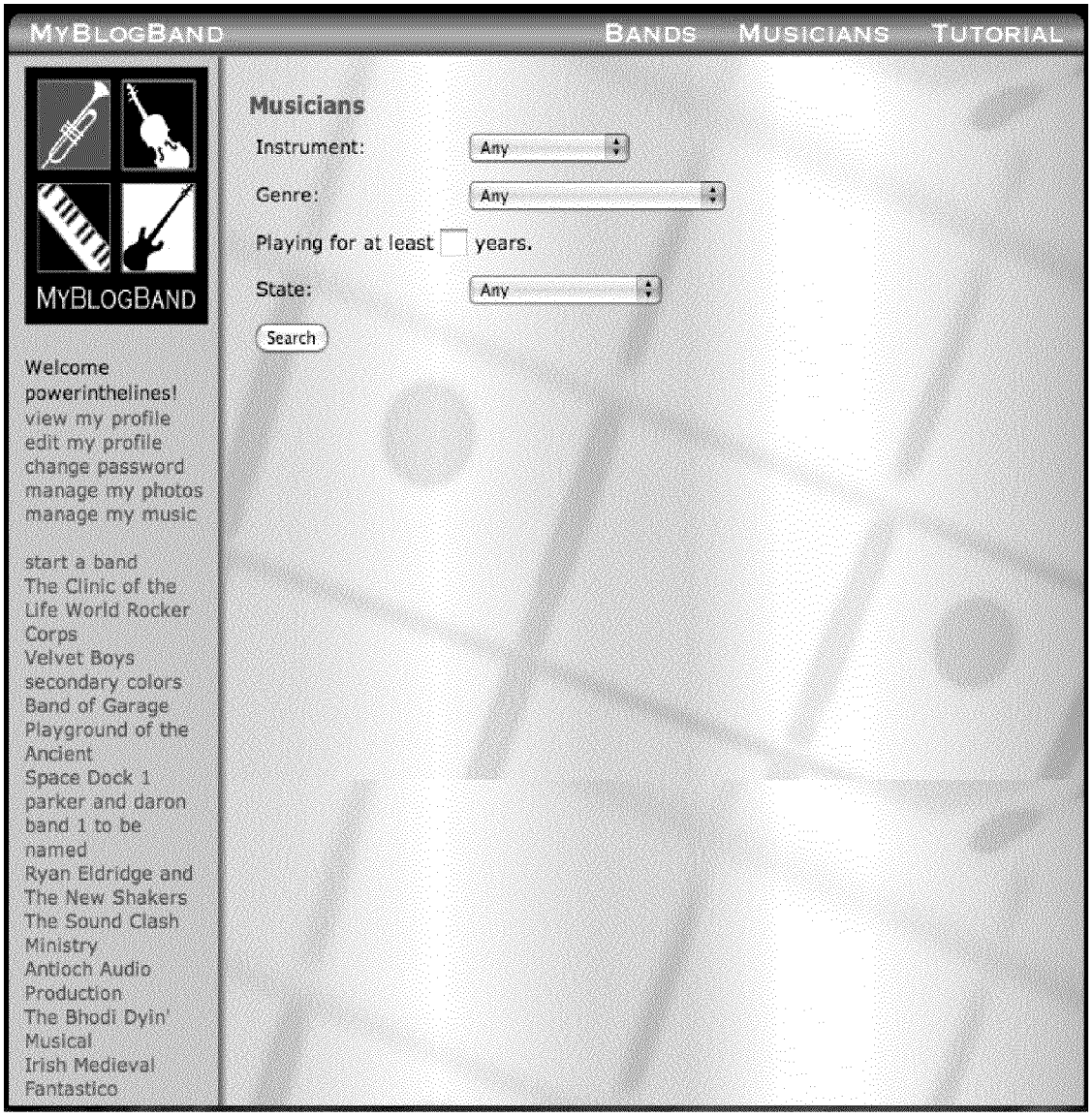
Figure 31:
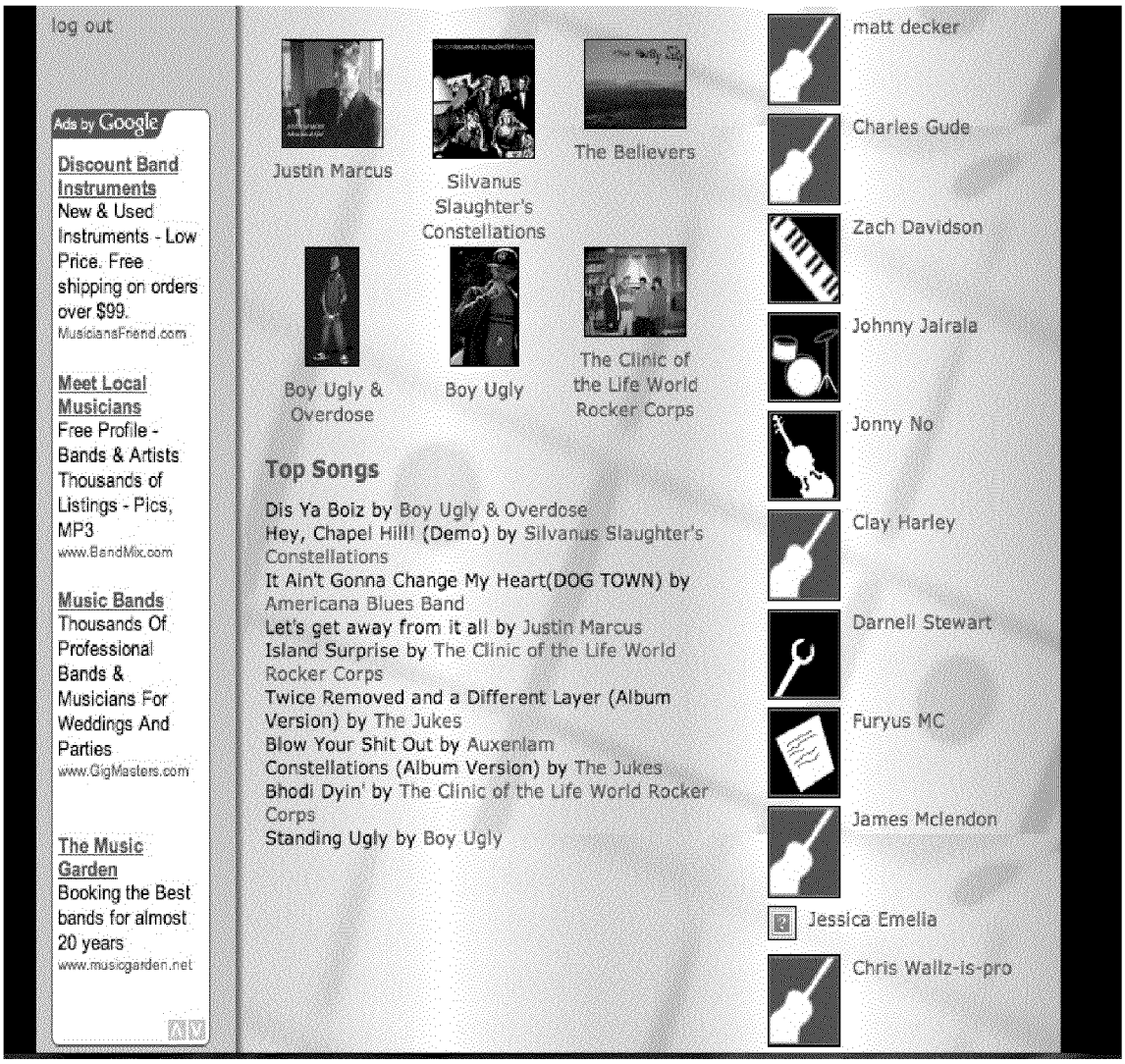
Figure 34:
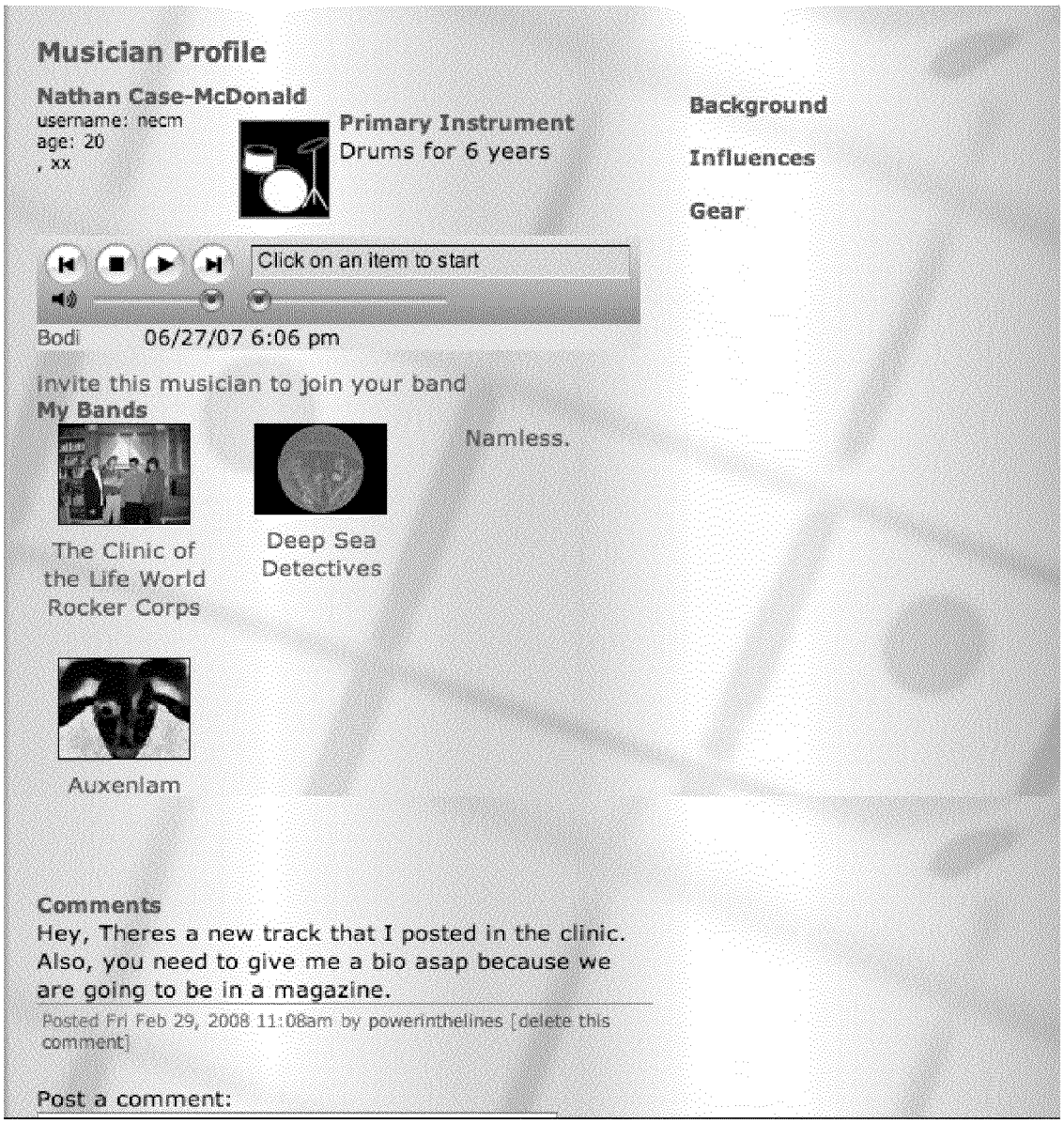
Figure 37:
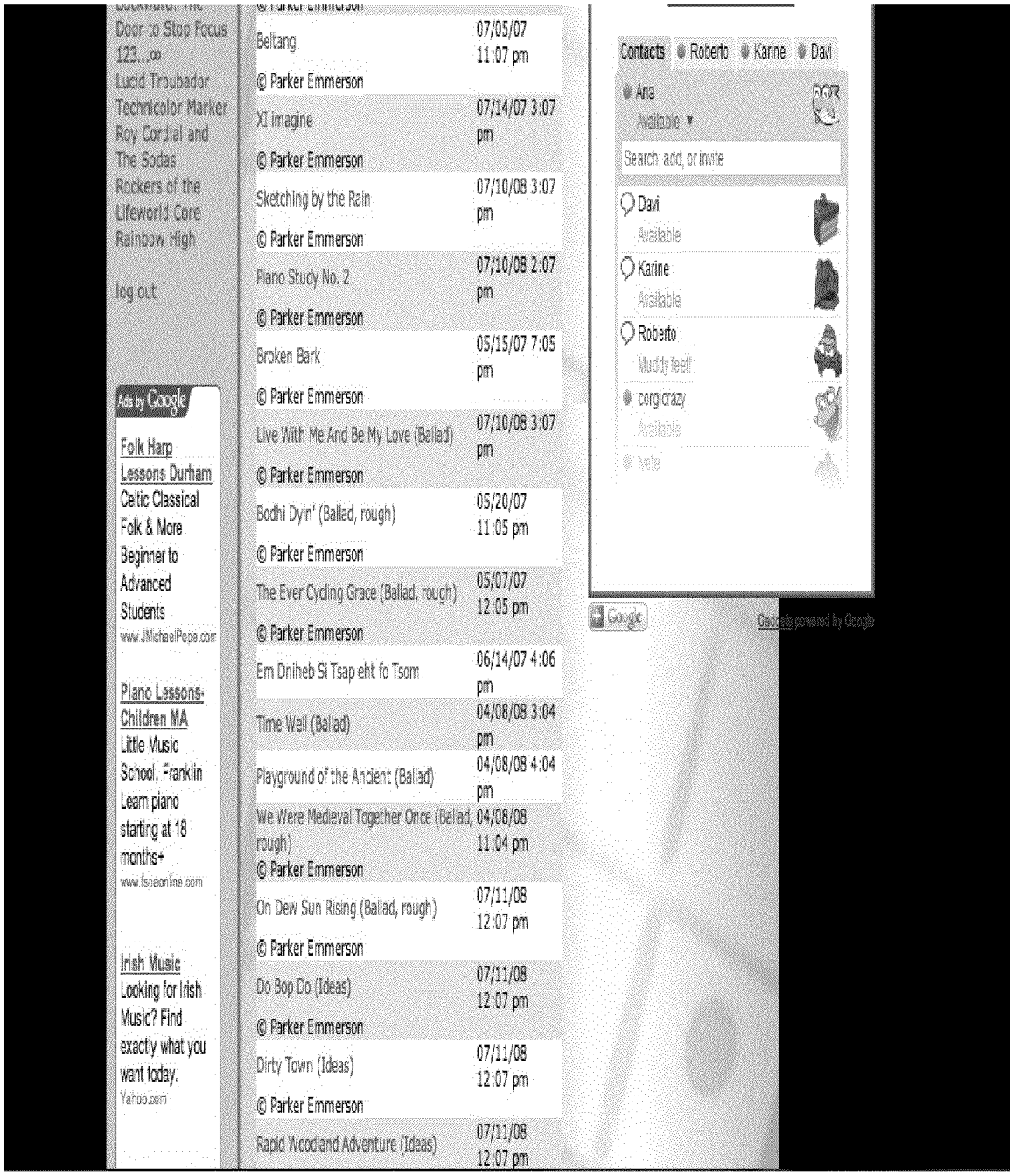
Figure 38:
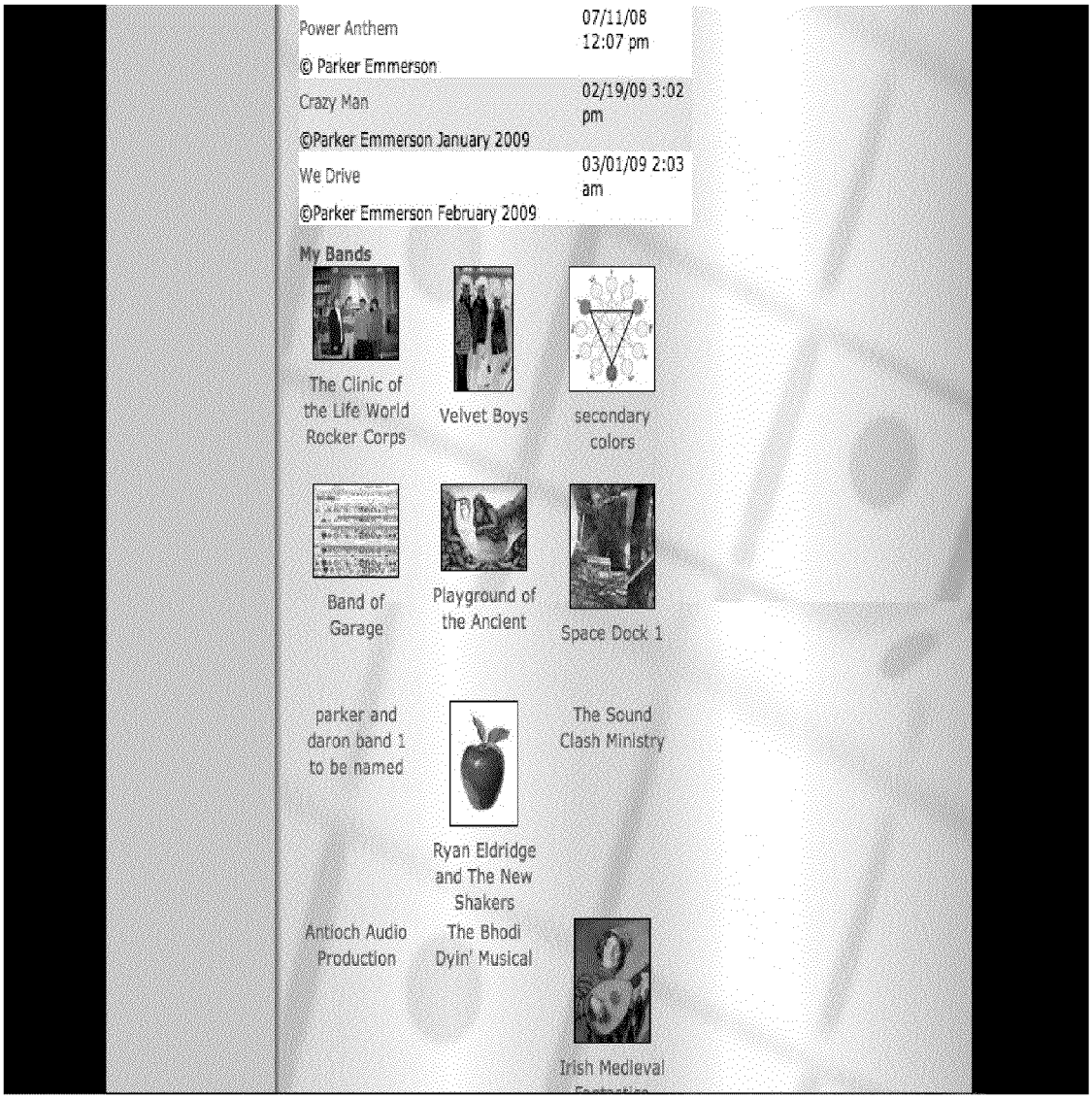
Figure 40:
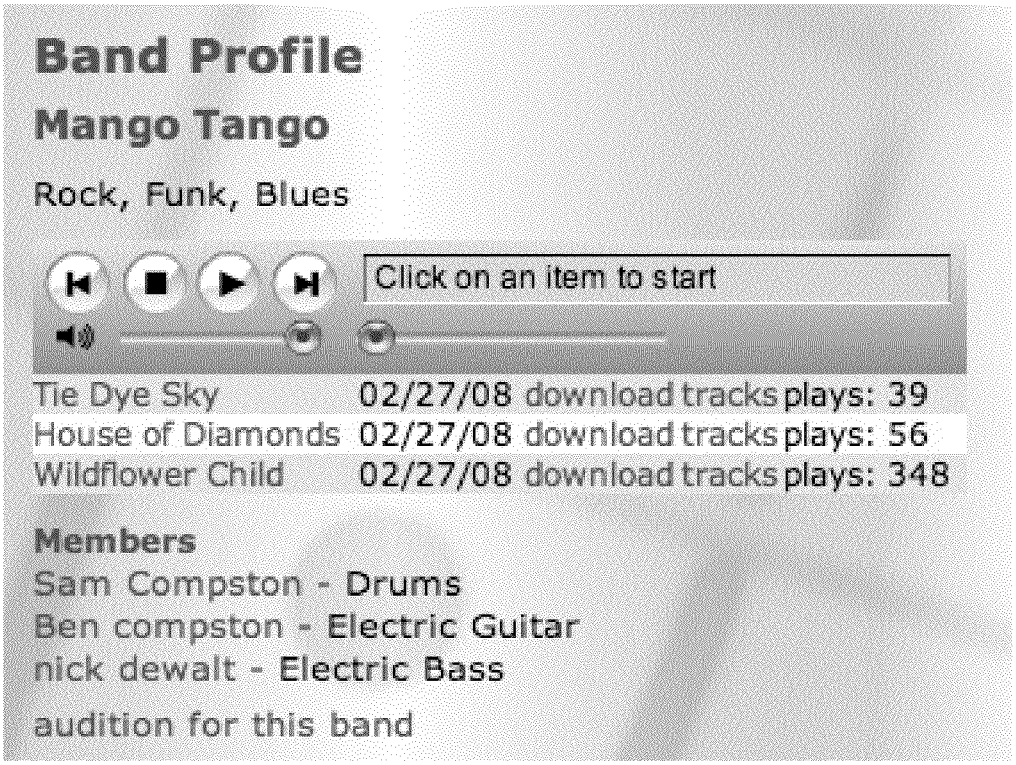
Figure 41:
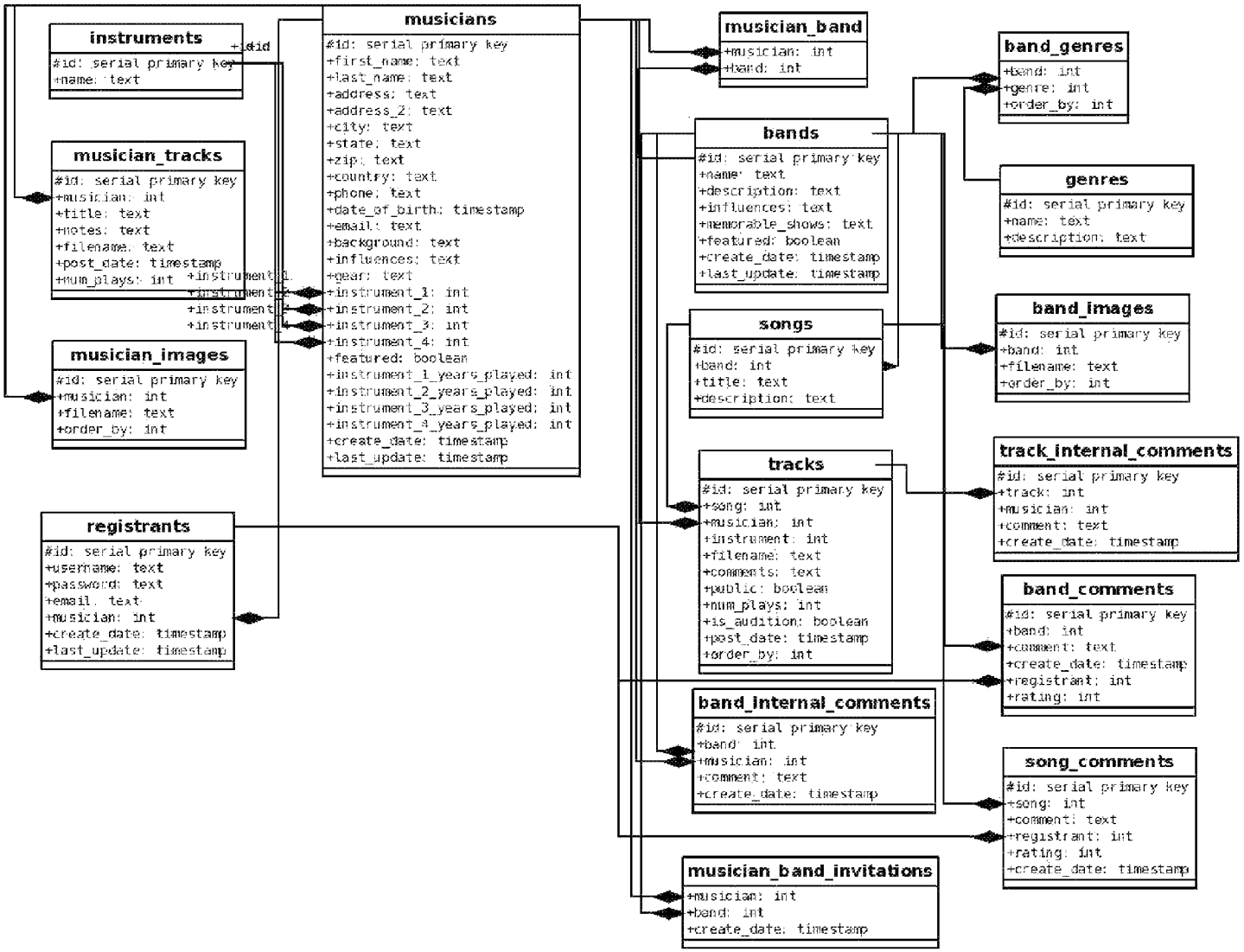

FIG. 2 provides a GUI for an individual user's playlist, entitled "My Music." Options for playing, editing, and deleting the tracks are provided for musician users. Dates of entry or upload are also provided. FIG. 3A provides an individual musician profile page, including photo, background, and other personal information, as well as tracks created by that user and uploaded to the site, including date/time stamp, and bands to which the musician is a contributing musician member or band member through the site. FIG. 3B provides a continuation of the individual musician profile page, further including comments from other users who are registered with the site. Public service ads by Google are also shown on the left side of the screen shot. FIGS. 3C-E provide more comments for the same musician page.

FIGS. 4, 5, and 6 provide band profile pages for different bands. The tracks are individually listed for each in the center of the page, including dates of creation/upload in the final form listed and total number of plays for each track. A download option is provided as well for each track.

FIGS. 7-10 provide screen shot displays for individual tracks by bands. Importantly, it is shown how on different dates/times there are different versions of the same track, including different band compositions, i.e., different musicians included on that track. In FIG. 8, three tracks are shown to illustrate how multiple versions of the same track are uploaded by different musicians in the same band on different dates and times; in this case, the band is called "secondary colors." In FIG. 10, for example, two tracks are shown, in which one provides for a track with violin on top of the basic or base track by the band called "The Clinic."

FIG. 11 provides an illustration of an interactive web page wherein the user establishes music search criteria by selecting the instrument type(s), genre(s), and indicates how many years the musician needs to have been playing. Also, a listing of the state or other geographic designation is provided (optional).

FIGS. 12-30 illustrate screen shots of GUIs showing aspects of the interactive website for systems and methods of the present invention.

FIGS. 31-40 illustrate screen shots of GUIs showing aspects of the interactive website for systems and methods of the present invention, with substantive illustration of virtual band and musician aspects in particular.

By way of example and not limitation, the following provides an illustration of user interaction according to one embodiment of the present invention, specifically by a user guide or help-based instructions. This description supports methods for musicians to connect to other musicians remotely by using web-based interaction, i.e., using the Internet to log onto a website online and exchange music (through upload/download) and ideas. Also, listeners can also log onto the website to discover new bands and musicians they might like as they can search for bands and musicians by genre. Several bands and musicians are featured on the home page, and the most played songs are listed in on the home page. Registration To participate in MyBlogBand.com, a user must register. To register, a user must enter a username, email and password. If the username or email are already in use, the user must pick another. Once registered, the user is logged in and can post comments to a band page. They also may continue on to become musicians. Any registered user can post comments on the band profile page. Musicians can fill out a profile, post pictures and tracks for others to listen to. Any of this can be edited at any time by logging in. Musicians may also participate in bands by starting a band and inviting other musicians to join, or auditioning for one of the many bands already on the site. To log in, enter your username and password in the log in boxes at the left hand column. If you've forgotten your password, you may click on "email me my password" and your password will be mailed to your email address. Once logged in, the log in box goes away, and a menu with various options appears in the left hand column. If you did not create a musician profile when you registered, you can create one now. If you have already created a musicians profile, you can view your profile by clicking on "view profile". You can make changes to or delete your profile by clicking on "edit my profile". It is important to choose genres that represent your music, as that will help others with similar interests find you. It is also important to choose instruments that you play, the amount of time you have been playing that instrument, and the state you live in as this information will be used by other musicians on the site to find you. You can change your password by clicking on the "change my password" link in the left hand column. You can add and remove images from your image gallery by clicking on "manage my images". Images are uploaded by selecting a local file using the "Browse" button and then clicking "Upload". Only jpeg images should be uploaded. Images can be reordered by using the pulldown boxes next to each image and selecting which position you would like that image to occupy. The first image is used as the thumbnail image for your musicians profile page, so choose an image that you like. You can add and remove tracks from your profile by clicking on the "manage my tracks" link. Tracks can be uploaded by selecting the file using the "Browse" button and then clicking on the "Upload" button. Depending on the type of connection you have, it may take several minutes to upload a track. Do not click on anything else while a track is uploading. Only MP3 tracks will be playable by the online player. Tracks must be named before they are uploaded. Bands Musicians can participate in bands in several ways. A musician may start a band. A band has a profile very similar to the musician profile. It is important to choose genres that are representative of this band so other musicians and listeners can find the band. Bands also have image galleries that work identically to the Musician image gallery described above. Once a musician creates a band, they can invite other musicians to join the band by searching for them using the "Musicians" menu item at the top of the page. If you have at least one band, and the musician is not in that band, a link will show up on that musicians profile page called "invite this musician to join your band". This will open a page where you select the band that you want to invite them to join and an optional message. An email will be sent to the invited musician. They can log in and accept your invitation. Band members should create at least one song that is representative of the band. This is done by clicking on the band name in the left hand column and then clicking on "manage band music". This will open a page where any current songs are listed, and a link to add a new song is available. Add a new song by clicking on the "add a new song" link and filling in a title and optional description. Once the song is created, tracks can be uploaded for this song. A song may have many tracks as the song develops and new parts are added. Tracks are added by clicking on the "tracks" link under the song on the "manage band music" page. Select a local file using the "Browse" button and then click "Upload". Please wait for the upload to complete as it may take some time depending on the type of internet connection you have. The first track uploaded becomes the "public" track for this song and is the one that shows up on the band profile page for this song. You can add notes for this track so that others know what the track is. You can make this a "private" track so that only other band members can see it, and you can decide if you want to make it downloadable by others. As more tracks are uploaded, you can decide which one is the "public" track. For instance, if you add a guitar solo to the song, you can upload a mix that includes this solo and make that the "public" track. Any musician can audition for any band that they are not already in. To do this, find a band using the "Bands" menu item at the top of the page, and click on the "audition for this band" link. This will allow you to upload a track for a song. The band members will get an email. A band member can log in, find the band and song that the musician has auditioned for, and listen to the track. The band members can keep the track or delete it. If they like the musician, they can invite them to join the band by clicking on their name and clicking on "invite this musician to join your band" on the profile page as described above.

Certain modifications and improvements will occur to those skilled in the art upon a reading of the foregoing description. By way of example and not limitation, methods for providing a filing system for albums or collections of tracks that provides for multiple musician and/or multiple group collaborations as set forth hereinabove. Also, a business model including the methods hereinabove wherein advertising is sold for generating targeted traffic for music, including the use of musical keywords wherein each music genre has keywords specifically associated with it so that advertisements can address niche markets related to those genres. The above mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

What is claimed is:

1. A system for creating a virtual band for providing online music composition comprising:

an interactive website and at least one remote computer running a browser;

the website accessible from the browser on the at least one remote computer device via a network;

a first musician entity and at least a second musician entity being self-selectively combinable to form the virtual band to collaborate musically to create at least one song;

the website operable for receiving a first track created off-line by the first musician entity;

the website further operable for receiving at least a second track created off-line by the second musician entity;

the website further operable for allowing the musician entities of the virtual band to selectively combine the received tracks by downloading and mixing the received tracks off-line and uploading the combined tracks;

the musician entities of the virtual bands giving at least one of the uploaded tracks or combined tracks the property of being the at least one song;

the website further operable for the musician entities of the virtual band to give the received tracks, the combined tracks, and the at least one song the property of being publically accessible to all visitors of the interactive website or privately accessible to only the musician entities of the virtual band; and the website further operable for allowing notation and HTML code posting for users to blog on the received tracks, the combined tracks and the at least one song which have the property of being publically accessible.

2. The system of claim 1, wherein the collaborative music composition is editable via the interactive website.

3. The system of claim 1, wherein the website is further operable for automatically saving and categorizing the at least one track according to the musician entity and a music genre.

4. The system of claim 1, wherein the web site is further operable for automatically saving and categorizing the at least one virtual band based upon a track categorization of the at least one track and/or based upon a musician entity categorization of any or all of the at least one musician entities of the virtual band.

5. The system of claim 1, wherein the website is further operable to include a publically accessible webpage for the at least one virtual band, the webpage including photos uploaded by the musician entities of the virtual band, the genre of the virtual band, the at least one songs and at least two tracks uploaded by the musician entities of the virtual band which are publically accessible, and links to webpages of the at least two musician entities of the virtual band.

6. The system of claim 1, wherein the website is further operable for downloading of the received tracks, the combined tracks, and the at least one song on a pay-per-download basis, the pay being distributed among the virtual band members.

7. A method for creating, organizing and managing a virtual band, the method steps including:

providing a system comprising a server in communication with an interactive website accessible with at least one remote computer device via a browser via a network;

the website operable for receiving a first track created off-line by the first musician entity and saving and categorizing the first track according to musician and genre;

the website further operable for at least a second musician entity selectively downloading and combining the first track and at least a second track, and the second musician entity saving the combined track via the browser;

the musician entities being self-selectively combinable to form at least one virtual band for online music creation, editing, and social network-based distribution through the interactive website;

the musician entities of the virtual bands giving at least one of the uploaded tracks or combined tracks the property of being a song;

the website further operable for the musician entities of the virtual band to give the received tracks, the combined tracks, and the at least one song the property of being publicly accessible to all visitors of the interactive website or privately accessible to only the musician entities of the virtual band; and the website further operable for allowing notation and HTML code posting for users to blog on the received tracks, combined tracks, and the at least one song which have the property of being publically accessible.

8. The method of claim 7, further including the step of editing the received tracks, the combined tracks, and the at least one song which have the property of being publically accessible.

9. The method of claim 7, further including the step of automatically saving and categorizing the virtual bands based upon a track categorization of the received tracks, the combined tracks, and the at least one song.

10. The method of claim 7, further including the step of the virtual band creating a downloadable playlist comprised of a selection from the received tracks, the combined tracks, and the at least one song.

11. The method of claim 7, the method steps further comprising:

the first musician entity posting a request for audition on the website;

the second musician entity selecting to respond to the request for audition;

the system emailing the first musician that an audition has been uploaded upon receipt of the combined track; and the first musician listening to the combined track and determining whether to keep the combined track or delete the combined track and whether to invite the second musician to join the virtual band.

12. A method for creating, organizing and managing a virtual band, the method steps comprising:

providing a system comprising a server in communication with an interactive website accessible with at least one remote computer device via a browser via a network, wherein the website is operable for receiving a request from a first musician entity for creating a band;

the website receiving a first track from a first remote source via the browser, the first track being created by the first musician entity;

the system saving and categorizing the first track according to musician and genre;

the system saving the first track as the public track for the band;

the system providing for managing the band music, including adding a new song, adding tracks to a song, adding notes to a track, and making a track private;

a second musician entity selectively downloading and combining the first track and a second track, and the second musician entity saving the combined tracks for creating a collaborative music composition via the browser; and wherein the first and second musician entities are self-selectively combinable to form at least one virtual band for online music creation, editing, and social network-based distribution through the interactive website.

* * * * *